US010594011B1

(12) United States Patent
Droz et al.

(10) Patent No.: US 10,594,011 B1
(45) **Date of Patent: *Mar. 17, 2020**

(54) DEVICES AND METHODS FOR A DIELECTRIC ROTARY JOINT

(71) Applicant: Waymo LLC, Mountain View, CA (US)

(72) Inventors: Pierre-yves Droz, Mountain View, CA (US); Adam Brown, Mountain View, CA (US); Daniel L. Rosenband, Mountain View, CA (US); Samuel William Lenius, Mountain View, CA (US)

(73) Assignee: Waymo LLC, Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/289,439

(22) Filed: Feb. 28, 2019

Related U.S. Application Data

(63) Continuation of application No. 15/960,159, filed on Apr. 23, 2018, now Pat. No. 10,263,309, which is a continuation of application No. 14/924,351, filed on Oct. 27, 2015, now Pat. No. 9,979,061.

(51) Int. Cl.

| | |
|---|---|
| ***H01P 1/06*** | (2006.01) |
| ***H01P 5/02*** | (2006.01) |
| ***H01P 3/16*** | (2006.01) |

(52) U.S. Cl.
CPC ..... *H01P 1/062* (2013.01); *H01P 3/16* (2013.01); *H01P 5/02* (2013.01)

(58) Field of Classification Search
CPC .... H01P 1/06; H01P 1/062; H01P 5/02; H01P 3/16; G02B 6/36; G02B 6/3604
USPC .... 385/16, 17, 25; 333/24 R, 254, 256, 260, 333/261
See application file for complete search history.

(56) References Cited

U.S. PATENT DOCUMENTS

| | | | |
|---|---|---|---|
| 5,042,896 | A | 8/1991 | Dahlgren |
| 6,062,739 | A | 5/2000 | Blake et al. |
| 6,446,867 | B1 | 9/2002 | Sanchez |
| 7,248,761 | B2 | 7/2007 | Schilling et al. |
| 8,335,409 | B2 | 12/2012 | Popp |
| 8,410,988 | B2 | 4/2013 | Iverson et al. |
| 8,786,385 | B1 | 7/2014 | Lorenc |

(Continued)

*Primary Examiner* — Rakesh B Patel
*Assistant Examiner* — Jorge L Salazar, Jr.
(74) *Attorney, Agent, or Firm* — McDonnell Boehnen Hulbert & Berghoff LLP

(57) ABSTRACT

A device is provided that includes a first waveguide configured to guide propagation of RF waves inside the first waveguide. A first side of the first waveguide is configured to emit an evanescent field associated with the propagation of the RF waves inside the first waveguide. The device also includes a second waveguide having a second side positioned within a predetermined distance to the first side of the first waveguide. The second waveguide is configured to guide propagation, inside the second waveguide, of induced RF waves associated with the evanescent field from the first waveguide. The device also includes a first probe coupled to the first waveguide and configured to emit the RF waves for propagation inside the first waveguide. The device also includes a second probe coupled to the second waveguide and configured to receive induced RF waves propagating inside the second waveguide.

18 Claims, 13 Drawing Sheets

(56) References Cited

U.S. PATENT DOCUMENTS

| | | | | |
|---|---|---|---|---|
| 8,917,149 | B2 | 12/2014 | Blech et al. | |
| 9,709,768 | B2 | 7/2017 | Nasvik et al. | |
| 9,979,061 | B1 * | 5/2018 | Droz | H01P 3/16 |
| 10,263,309 | B1 * | 4/2019 | Droz | H01P 3/16 |
| 2004/0204734 | A1 | 10/2004 | Wagner et al. | |
| 2005/0063709 | A1 | 3/2005 | Poisel et al. | |
| 2007/0063785 | A1 | 3/2007 | Krumme et al. | |
| 2007/0086782 | A1 | 4/2007 | Schilling et al. | |
| 2012/0093041 | A1 * | 4/2012 | Takeda | H04B 1/034<br>370/280 |
| 2015/0130565 | A1 | 5/2015 | Henderson et al. | |

* cited by examiner

DEVICES AND METHODS FOR A DIELECTRIC ROTARY JOINT

CROSS-REFERENCE TO RELATED APPLICATIONS

This application is a continuation of U.S. application Ser. No. 15/960,159 filed Apr. 23, 2018, which is a continuation of U.S. application Ser. No. 14/924,351 filed Oct. 27, 2015, the contents of each of which are entirely incorporated herein by reference as if fully set forth in this application.

BACKGROUND

Unless otherwise indicated herein, the materials described in this section are not prior art to the claims in this application and are not admitted to be prior art by inclusion in this section.

Rotary joint devices are typically used for transmission of power and/or electrical signals between one structure and another structure in an electromechanical system that operates by causing a relative rotation between the two structures (e.g., stator and rotor). Example systems that employ rotary joint devices include remote sensing systems (e.g., RADARs, LIDARs, etc.) and robotic systems (e.g., for directing microphones, speakers, other robotic components, etc.), among other possibilities.

A slip ring joint is an example rotary joint device that typically involves a conducting brush disposed in one structure to remain largely in contact with a conducting ring disposed in the other structure as the rotor rotates. Slip ring joints may be associated with high maintenance and/or production costs due to the damaging effect of friction between the brush and the ring as the rotor rotates.

An optical rotary joint is an example rotary joint device that typically involves a light source disposed in one structure to emit modulated light indicative of transmitted data towards a photodetector disposed in the other structure. Optical rotary joints may be associated with data transmission rate limitations due to an extent of possible light modulations that can be uniquely detected by the photodetector.

A radio-frequency (RF) rotary joint is an example rotary joint device that typically involves an antenna disposed in one structure to emit RF electromagnetic waves towards another antenna disposed in the other structure. RF rotary joints may be associated with data transmission rate limitations due to the relative motion between the two antennas as the rotor rotates. By way of example, the relative motion between the two antennas may cause variations in polarizations of the respective antennas, or mismatches between beamforming patterns of the respective antennas, among other possibilities. As a result, the relative rotation between the two structures may affect the quality of wireless communication between the two antennas. Thus, due to the relative rotation between the two structures, the available RF bandwidth for reliable wireless data transmission between the two antennas may be limited.

SUMMARY

In one example, a device is provided that includes a first dielectric waveguide configured to guide propagation of radio-frequency (RF) electromagnetic waves inside the first dielectric waveguide. A first side of the first dielectric waveguide is configured to emit an evanescent field associated with the propagation of the RF waves inside the first dielectric waveguide. The device also includes a second dielectric waveguide having a second side positioned within a predetermined distance to the first side of the first dielectric waveguide. The second dielectric waveguide is configured to guide propagation, inside the second dielectric waveguide, of induced RF waves associated with the evanescent field from the first dielectric waveguide. The device also includes a first probe coupled to the first dielectric waveguide and configured to emit the RF waves for propagation inside the first dielectric waveguide. The device also includes a second probe coupled to the second dielectric waveguide and configured to receive the induced RF waves propagating inside the second dielectric waveguide.

In another example, a method is provided that involves transmitting radio-frequency (RF) electromagnetic waves into a first dielectric waveguide configured to guide propagation of the RF waves inside the first dielectric waveguide. A first side of the first dielectric waveguide is configured to emit an evanescent field associated with the propagation of the RF waves inside the first dielectric waveguide. The method also involves detecting induced RF waves propagating inside a second dielectric waveguide having a second side positioned within a predetermined distance to the first side of the first dielectric waveguide. The induced RF waves are associated with the evanescent field from the first dielectric waveguide.

In yet another example, a device is provided that includes a first dielectric waveguide configured to guide propagation of first radio-frequency (RF) electromagnetic waves inside the first dielectric waveguide. A first side of the first dielectric waveguide is configured to emit a first evanescent field associated with the propagation of the first RF waves inside the first dielectric waveguide. The device also includes a second dielectric waveguide having a second side positioned within a predetermined distance to the first side of the first dielectric waveguide. The second dielectric waveguide is configured to guide propagation of second RF waves inside the second dielectric waveguide. The second side of the second dielectric waveguide is configured to emit a second evanescent field associated with the propagation of the second RF waves inside the second dielectric waveguide. The first RF waves propagating inside the first dielectric wave guide include first induced RF waves associated with the second evanescent field from the second dielectric waveguide. The second RF waves propagating inside the second dielectric waveguide include second induced RF waves associated with the first evanescent field from the first dielectric waveguide. The device also includes a first probe coupled to the first dielectric waveguide. The device also includes a second probe coupled to the second dielectric waveguide. The first probe is configured to wirelessly communicate with the second probe via the first RF waves propagating inside the first dielectric waveguide. The second probe is configured to wirelessly communicate with the first probe via the second RF waves propagating inside the second dielectric waveguide.

In still another example, a system is provided that includes means for transmitting radio-frequency (RF) electromagnetic waves into a first dielectric waveguide configured to guide propagation of the RF waves inside the first dielectric waveguide. A first side of the first dielectric waveguide is configured to emit an evanescent field associated with the propagation of the RF waves inside the first dielectric waveguide. The system also comprises means for detecting induced RF waves propagating inside a second dielectric waveguide having a second side positioned within a predetermined distance to the first side of the first dielectric waveguide. The induced RF waves are associated with the evanescent field from the first dielectric waveguide.

These as well as other aspects, advantages, and alternatives, will become apparent to those of ordinary skill in the art by reading the following detailed description, with reference where appropriate to the accompanying figures.

DETAILED DESCRIPTION

Figure 1A:
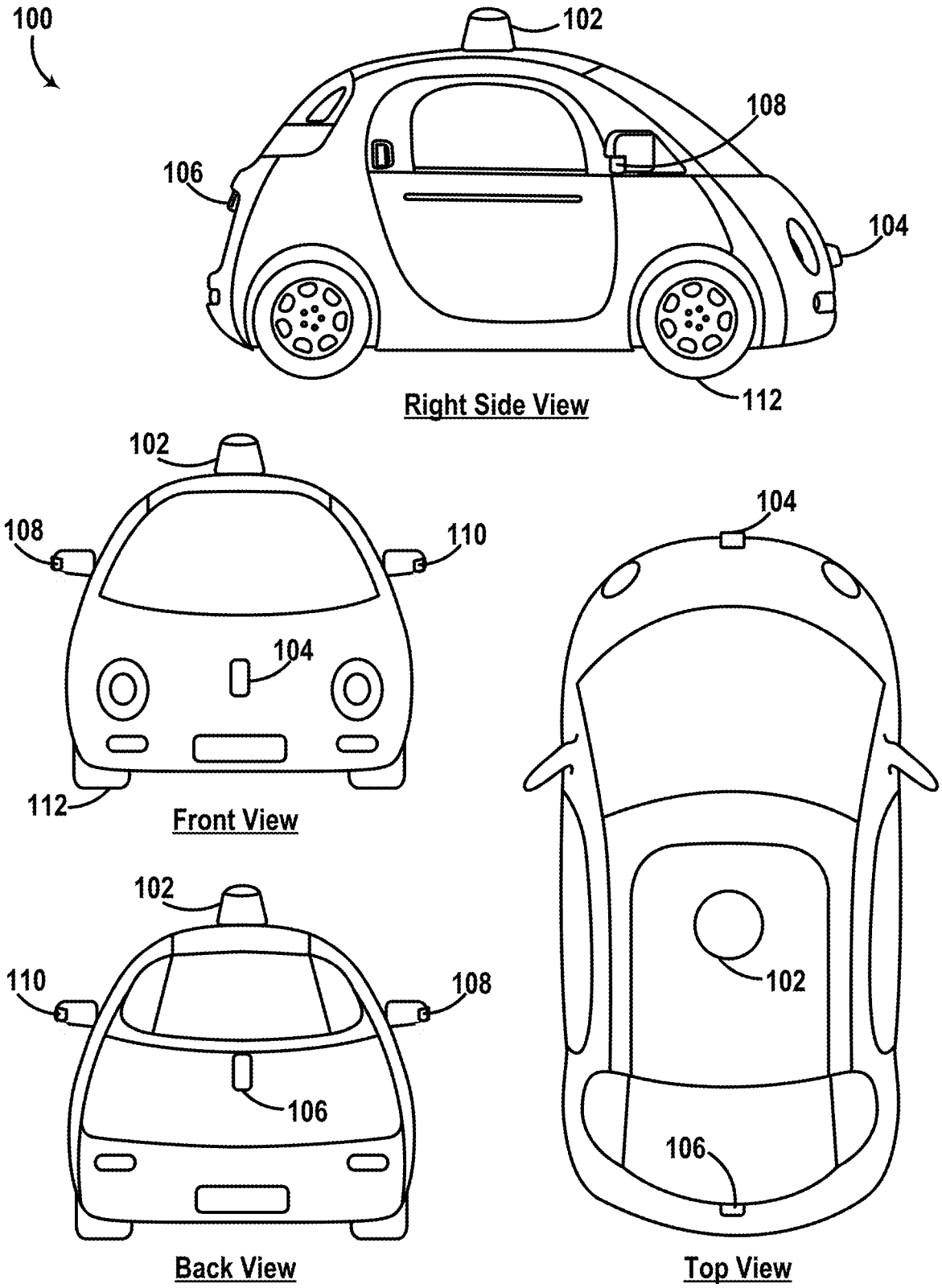
FIG. 1A illustrates a vehicle, according to an example embodiment.

The following detailed description describes various features and functions of the disclosed systems, devices and methods with reference to the accompanying figures. In the figures, similar symbols identify similar components, unless context dictates otherwise. The illustrative system, device and method embodiments described herein are not meant to be limiting. It may be readily understood by those skilled in the art that certain aspects of the disclosed systems, devices and methods can be arranged and combined in a wide variety of different configurations, all of which are contemplated herein.

I. OVERVIEW

In an example embodiment, a rotary joint includes two waveguides arranged such that a first side of a first waveguide remains within a predetermined distance to a second side of a second waveguide in response to a relative rotation between the two waveguides. For instance, the two waveguides may have substantially circular-arc shaped edges, and may be arranged concentrically about a common axis of the respective circular-arc shaped edges to maintain an overlap between the two respective sides separated by the predetermined distance in response to rotation of any of the two waveguides about the common axis.

In this embodiment, the two waveguides may comprise a dielectric material suitable for guiding propagation of RF waves inside the respective waveguides. For example, each of the two waveguides may include dielectric materials (e.g., acrylic, acrylic polymer, non-acrylic dielectric materials, etc.) having characteristics (e.g., material type, dimensions, etc.) that are suitable for supporting a propagating-wave mode of RF waves within a particular RF bandwidth.

Additionally, in this embodiment, the rotary joint may include a first probe coupled to the first waveguide to emit RF waves for propagation inside the first waveguide. For example, the first probe may include an antenna configured to steer the RF waves into the first waveguide at a predetermined angle associated with the dielectric material characteristics of the first waveguide to cause an internal reflection of the RF waves at one or more sides of the first waveguide. As the RF waves reflect off the first side of the first waveguide (i.e., the side adjacent to the second waveguide), the dielectric material characteristics of the first waveguide may allow the first side to emit an evanescent field associated with the RF waves propagating inside the first waveguide. The evanescent field may couple with the second side of the second waveguide to induce propagation of induced RF waves inside the second waveguide.

Additionally, in this embodiment, the rotary joint may include a second probe coupled to the second waveguide to receive the induced RF waves associated with the evanescent field from the first waveguide. Thus, in such an embodiment, the rotary joint may mitigate the effects of the relative motion between the two probes (e.g., polarization variations, beamforming pattern variations, etc.), and a more stable wireless communication interface can be established between the two probes over a wider RF bandwidth.

In some implementations described herein, one or both of the two waveguides may include a cladding layer disposed on one or more sides of the respective waveguide other than the respective side that is adjacent to the other waveguide. For example, the cladding layer may comprise a material having a suitable index of refraction for reducing an amount of energy evanescing out of the one or more sides (e.g., enhance the internal reflection of the RF waves at the one or more sides). Thus, in such implementations, a higher amount of energy from the RF waves emitted by the first probe may be available for evanescence at the first side that is within the predetermined distance to the second waveguide. Additionally or alternatively, in such implementations, a higher amount of energy from the induced RF waves propagating inside the second waveguide may be available for receipt by the second probe.

In some implementations described herein, the rotary joint may also include a dielectric fluid interposed between the two adjacent sides of the respective waveguides. For example, the dielectric fluid may have a suitable viscosity to allow rotation of the first dielectric waveguide relative to the second dielectric waveguide, while also having a low attenuation coefficient for the particular RF band associated with the RF waves propagating inside the first waveguide. Thus, in such implementations, the low attenuation coefficient of the dielectric fluid may mitigate attenuation of the evanescent field over the predetermined distance between the two waveguides.

II. ILLUSTRATIVE ELECTROMECHANICAL SYSTEMS AND DEVICES

Systems and devices in which example embodiments may be implemented will now be described in greater detail. In general, the embodiments disclosed herein can be used with any electromechanical system that includes a moveable component. The system can provide for transmission of power and/or signals between the moveable component and other parts of the system. Illustrative embodiments described herein include vehicles that have moveable components such as sensors and wheels that communicate with other components of the vehicle and/or with one another. However, an example electromechanical system may also be implemented in or take the form of other devices, such as sensing platforms (e.g., rotational RADAR platforms, rotational LIDAR platforms, directional sensing platforms, etc.), robotic devices, vehicles, industrial systems (e.g., assembly lines, etc.), medical devices (e.g., medical imaging devices, etc.), or mobile communication systems, among other possibilities.

The term "vehicle" is broadly construed herein to cover any moving object, including, for instance, an aerial vehicle, watercraft, spacecraft, a car, a truck, a van, a semi-trailer truck, a motorcycle, a golf cart, an off-road vehicle, a warehouse transport vehicle, or a farm vehicle, as well as a carrier that rides on a track such as a rollercoaster, trolley, tram, or train car, among other examples.

FIG. 1A illustrates a vehicle 100, according to an example embodiment. In particular, FIG. 1A shows a Right Side View, Front View, Back View, and Top View of the vehicle 100. Although vehicle 100 is illustrated in FIG. 1A as a car, as discussed above, other embodiments are possible. Furthermore, although the example vehicle 100 is shown as a vehicle that may be configured to operate in autonomous mode, the embodiments described herein are also applicable to vehicles that are not configured to operate autonomously. Thus, the example vehicle 100 is not meant to be limiting. As shown, the vehicle 100 includes five sensor units 102, 104, 106, 108, and 110, and four wheels, exemplified by wheel 112.

In some embodiments, each of the sensor units 102-110 may include one or more light detection and ranging devices (LIDARs) that have particular configuration properties to allow scanning an environment around the vehicle 100. Additionally or alternatively, in some embodiments, the sensor units 102-110 may include any combination of sensors, such as global positioning system sensors, inertial measurement units, radio detection and ranging (RADAR) units, cameras, laser rangefinders, LIDARs, and/or acoustic sensors among other possibilities.

As shown, the sensor unit 102 is mounted to a top side of the vehicle 100 opposite to a bottom side of the vehicle 100 where the wheel 112 is mounted. Further, the sensor units 104-110 are each mounted to a given side of the vehicle 100 other than the top side. For example, the sensor unit 104 is positioned at a front side of the vehicle 100, the sensor 106 is positioned at a back side of the vehicle 100, the sensor unit 108 is positioned at a right side of the vehicle 100, and the sensor unit 110 is positioned at a left side of the vehicle 100.

While the sensor units 102-110 are shown to be mounted in particular locations on the vehicle 100, in some embodiments, the sensor units 102-110 may be mounted elsewhere on the vehicle 100, either inside or outside the vehicle 100. For example, although FIG. 1A shows the sensor unit 108 mounted to a rear-view mirror of the vehicle 100, the sensor unit 108 may alternatively be positioned in another location along the right side of the vehicle 100. Further, while five sensor units are shown, in some embodiments more or fewer sensor units may be included in the vehicle 100. However, for the sake of example, the sensor units 102-110 are positioned as shown in FIG. 1A.

In some embodiments, one or more of the sensor units 102-110 may include one or more movable mounts on which the sensors may be movably mounted. The movable mount may include, for example, a rotating platform. Sensors mounted on the rotating platform could be rotated so that the sensors may obtain information from various directions around the vehicle 100. For example, a LIDAR of the sensor unit 102 may have a viewing direction that can be adjusted by actuating the rotating platform to a different direction, etc. Alternatively or additionally, the movable mount may include a tilting platform. Sensors mounted on the tilting platform could be tilted within a given range of angles and/or azimuths so that the sensors may obtain information from a variety of angles. The movable mount may take other forms as well.

Further, in some embodiments, one or more of the sensor units 102-110 may include one or more actuators configured to adjust the position and/or orientation of sensors in the sensor unit by moving the sensors and/or movable mounts. Example actuators include motors, pneumatic actuators, hydraulic pistons, relays, solenoids, and piezoelectric actuators. Other actuators are possible as well.

As shown, the vehicle 100 includes one or more wheels such as the wheel 112 that are configured to rotate to cause the vehicle to travel along a driving surface. In some embodiments, the wheel 112 may include at least one tire coupled to a rim of the wheel 112. To that end, the wheel 112 may include any combination of metal and rubber, or a combination of other materials. The vehicle 100 may include one or more other components in addition to or instead of those shown.

Figure 1B:
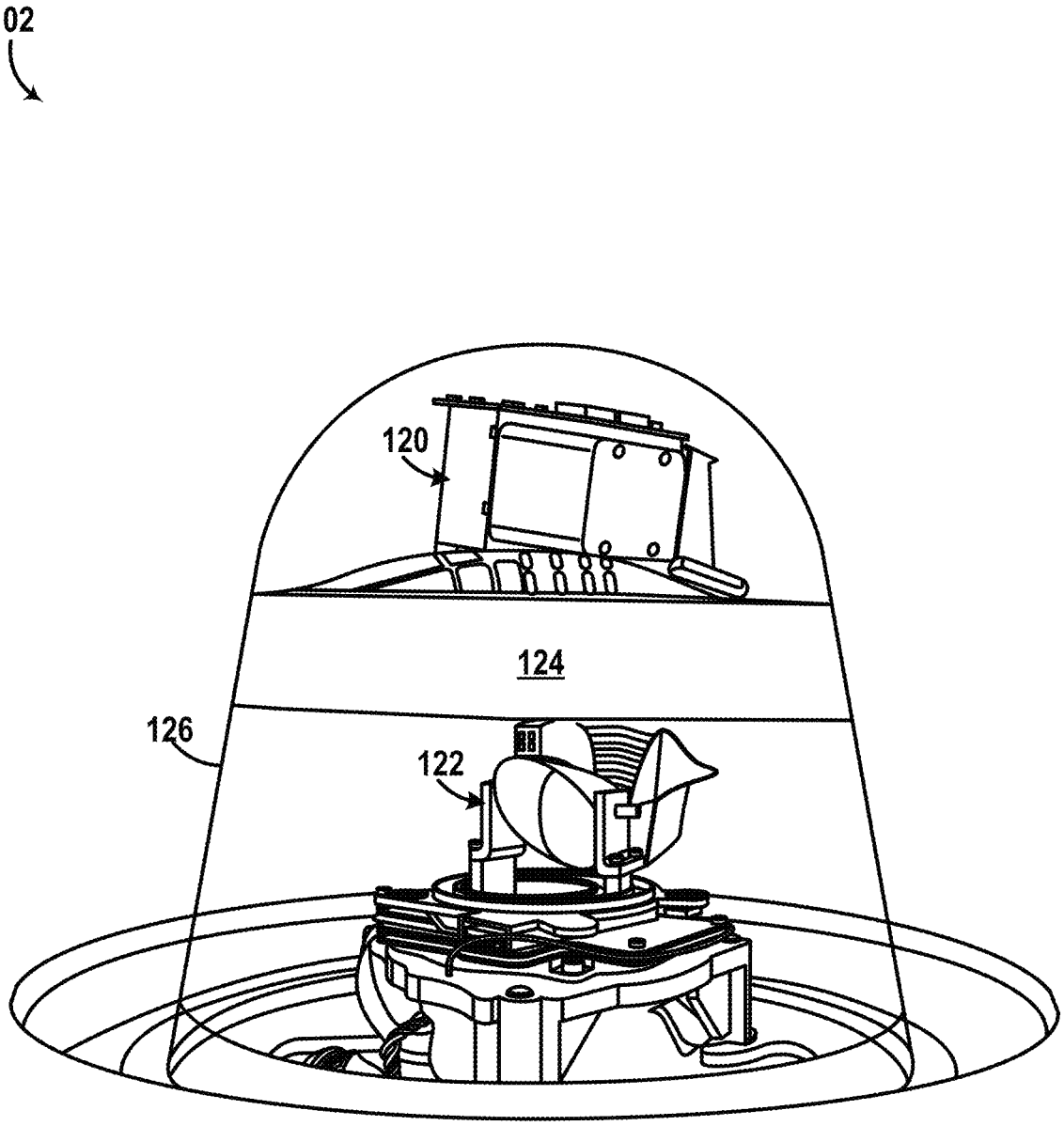
FIG. 1B is a perspective view of a sensor unit positioned at a top side of the vehicle shown in FIG. 1A, according to an example embodiment.

FIG. 1B is a perspective view of the sensor unit 102 positioned at the top side of the vehicle 100 shown in FIG. 1A. As shown, the sensor unit 102 includes a first LIDAR 120, a second LIDAR 122, a dividing structure 124, and light filter 126. As noted above, the sensor unit 102 may additionally or alternatively include other sensors than those shown in FIG. 1B. However, for the sake of example, the sensor unit 102 includes the components shown in FIG. 1B.

In some examples, the first LIDAR 120 may be configured to scan an environment around the vehicle 100 by rotating about an axis (e.g., vertical axis, etc.) while emitting one or more light pulses and detecting reflected light pulses off objects in the environment of the vehicle, for example. In some embodiments, the first LIDAR 120 may be configured to repeatedly rotate about the axis to be able to scan the environment at a sufficiently high refresh rate to quickly detect motion of objects in the environment. For instance, the first LIDAR 120 may have a refresh rate of 10 Hz (e.g., ten complete rotations of the first LIDAR 120 per second), thereby scanning a 360-degree field-of-view (FOV) around the vehicle ten times every second. Through this process, for instance, a 3D map of the surrounding environment may be determined based on data from the first LIDAR 120. In one embodiment, the first LIDAR 120 may include a plurality of light sources that emit 64 laser beams having a wavelength of 905 nm. In this embodiment, the 3D map determined based on the data from the first LIDAR 120 may have a 0.2° (horizontal)×0.3° (vertical) angular resolution, and the first LIDAR 120 may have a 360° (horizontal)×20° (vertical) FOV of the environment. In this embodiment, the 3D map may have sufficient resolution to detect or identify objects within a medium range of 100 meters from the vehicle 100, for example. However, other configurations (e.g., number of light sources, angular resolution, wavelength, range, etc.) are possible as well.

In some embodiments, the second LIDAR 122 may be configured to scan a narrower FOV of the environment around the vehicle 100. For instance, the second LIDAR 122 may be configured to rotate (horizontally) for less than a complete rotation about a similar axis. Further, in some examples, the second LIDAR 122 may have a lower refresh rate than the first LIDAR 120. Through this process, the vehicle 100 may determine a 3D map of the narrower FOV of the environment using the data from the second LIDAR 122. The 3D map in this case may have a higher angular resolution than the corresponding 3D map determined based on the data from the first LIDAR 120, and may thus allow detection/identification of objects that are further than the medium range of distances of the first LIDAR 120, as well as identification of smaller objects within the medium range of distances. In one embodiment, the second LIDAR 122 may have a FOV of 8° (horizontal)×15° (vertical), a refresh rate of 4 Hz, and may emit one narrow beam having a wavelength of 1550 nm. In this embodiment, the 3D map determined based on the data from the second LIDAR 122 may have an angular resolution of 0.1° (horizontal)×0.03° (vertical), thereby allowing detection/identification of objects within a long range of 300 meters to the vehicle 100. However, other configurations (e.g., number of light sources, angular resolution, wavelength, range, etc.) are possible as well.

In some examples, the vehicle 100 may be configured to adjust a viewing direction of the second LIDAR 122. For example, while the second LIDAR 122 has a narrow horizontal FOV (e.g., 8 degrees), the second LIDAR 122 may be mounted to a stepper motor (not shown) that allows adjusting the viewing direction of the second LIDAR 122 to directions other than that shown in FIG. 1B. Thus, in some examples, the second LIDAR 122 may be steerable to scan the narrow FOV along any viewing direction from the vehicle 100.

The structure, operation, and functionality of the first LIDAR 120 and the second LIDAR 122 are described in greater detail within exemplary embodiments herein.

The dividing structure 124 may be formed from any solid material suitable for supporting the first LIDAR 120 and/or optically isolating the first LIDAR 120 from the second LIDAR 122. Example materials may include metals, plastics, foam, among other possibilities.

The light filter 126 may be formed from any material that is substantially transparent to light having wavelengths with a wavelength range, and substantially opaque to light having wavelengths outside the wavelength range. For example, the light filter 126 may allow light having the first wavelength of the first LIDAR 120 (e.g., 905 nm) and the second wavelength of the second LIDAR 122 (e.g., 1550 nm) to propagate through the light filter 126. As shown, the light filter 126 is shaped to enclose the first LIDAR 120 and the second LIDAR 122. Thus, in some examples, the light filter 126 may also be configured to prevent environmental damage to the first LIDAR 120 and the second LIDAR 122, such as accumulation of dust or collision with airborne debris among other possibilities. In some examples, the light filter 126 may be configured to reduce visible light propagating through the light filter 126. In turn, the light filter 126 may improve an aesthetic appearance of the vehicle 100 by enclosing the first LIDAR 120 and the second LIDAR 122, while reducing visibility of the components of the sensor unit 102 from a perspective of an outside observer, for example. In other examples, the light filter 126 may be configured to allow visible light as well as the light from the first LIDAR 120 and the second LIDAR 122.

In some embodiments, portions of the light filter 126 may be configured to allow different wavelength ranges to propagate through the light filter 126. For example, an upper portion of the light filter 126 above the dividing structure 124 may be configured to allow propagation of light within a first wavelength range that includes the first wavelength of the first LIDAR 120. Further, for example, a lower portion of the light filter 126 below the dividing structure 124 may be configured to allow propagation of light within a second wavelength range that includes the second wavelength of the second LIDAR 122. In other embodiments, the wavelength range associated with the light filter 126 may include both the first wavelength of the first LIDAR 120 and the second wavelength of the second LIDAR 122.

In one embodiment, as shown, the light filter 126 has a dome shape and provides a dome-shaped housing for the first LIDAR 120 and the second LIDAR 122. For instance, the dome-shaped housing (e.g., light filter 126) may include the dividing structure 124 that is positioned between the first LIDAR 120 and the second LIDAR 122. Thus, in this embodiment, the first LIDAR 120 may be disposed within the dome-shaped housing. Further, in this embodiment, the second LIDAR 122 may also be disposed within the dome-shaped housing and may be positioned between the first LIDAR 120 and the top side of the vehicle 100 as shown in FIG. 1B.

Figure 1C:
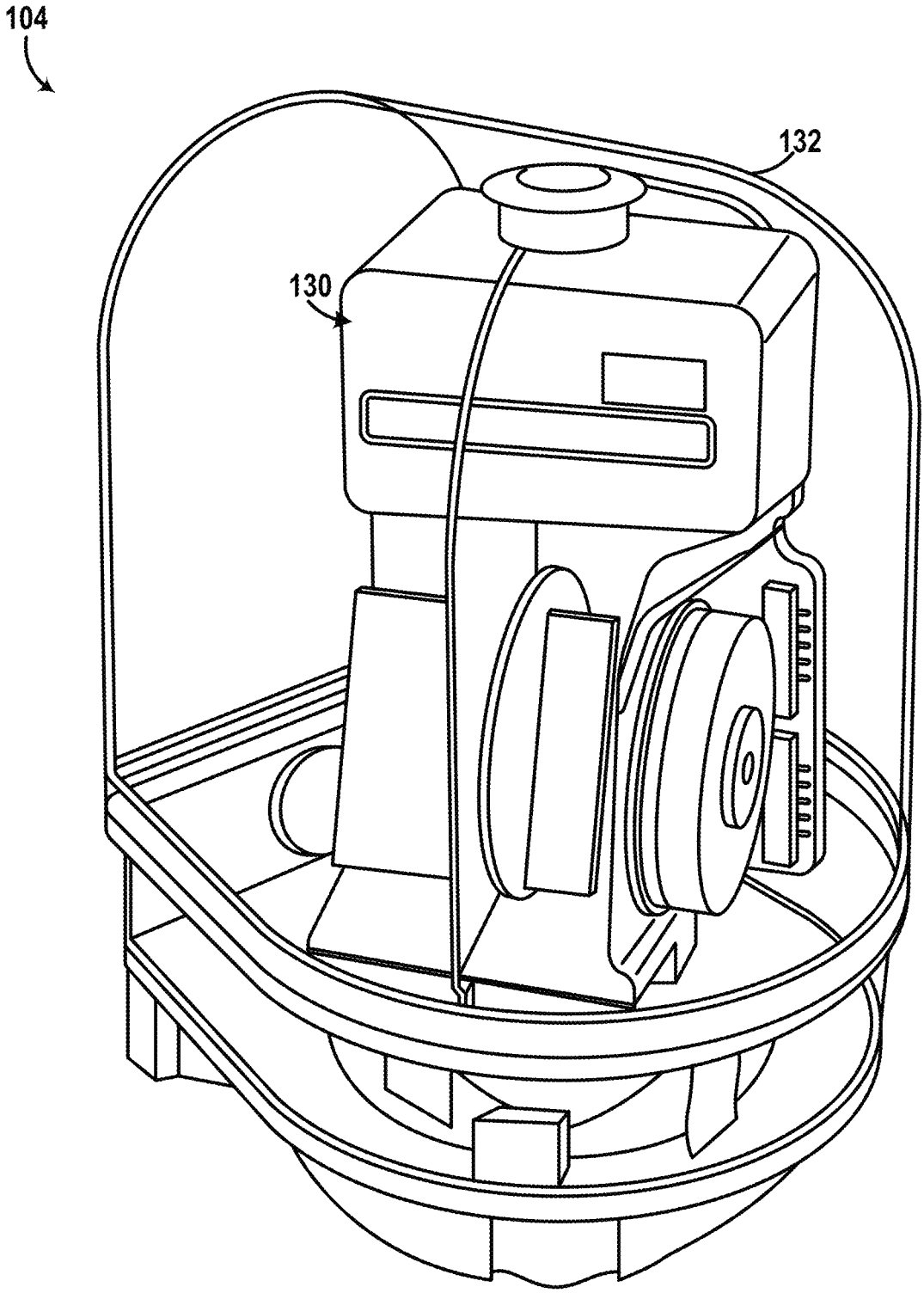
FIG. 1C is a perspective view of a sensor unit positioned at a front side of the vehicle shown in FIG. 1A, according to an example embodiment.

FIG. 1C is a perspective view of the sensor unit 104 positioned at the front side of the vehicle 100 shown in FIG. 1A. In some examples, the sensor units 106, 108, and 110 may be configured similarly to the sensor unit 104 illustrated in FIG. 1C. As shown, the sensor unit 104 includes a third LIDAR 130 and a light filter 132. As noted above, the sensor unit 104 may additionally or alternatively include other sensors than those shown in FIG. 1C. However, for the sake of example, the sensor unit 104 includes the components shown in FIG. 1C.

The third LIDAR 130 may be configured to scan a FOV of the environment around the vehicle 100 that extends away from a given side of the vehicle 100 (i.e., the front side) where the third LIDAR 130 is positioned. Thus, in some examples, the third LIDAR 130 may be configured to rotate (e.g., horizontally) across a wider FOV than the second LIDAR 122 but less than the 360-degree FOV of the first LIDAR 120 due to the positioning of the third LIDAR 130. In one embodiment, the third LIDAR 130 may have a FOV of 270° (horizontal)×110° (vertical), a refresh rate of 4 Hz, and may emit one laser beam having a wavelength of 905 nm. In this embodiment, the 3D map determined based on the data from the third LIDAR 130 may have an angular resolution of 1.2° (horizontal)×0.2° (vertical), thereby allowing detection/identification of objects within a short range of 30 meters to the vehicle 100. However, other configurations (e.g., number of light sources, angular resolution, wavelength, range, etc.) are possible as well. The structure, operation, and functionality of the third LIDAR 130 are described in greater detail within exemplary embodiments of the present disclosure.

The light filter 132 may be similar to the light filter 126 of FIG. 1B. For example, the light filter 132 may be shaped to enclose the third LIDAR 130. Further, for example, the light filter 132 may be configured to allow light within a wavelength range that includes the wavelength of light from the third LIDAR 130 to propagate through the light filter 132. In some examples, the light filter 132 may be configured to reduce visible light propagating through the light filter 132, thereby improving an aesthetic appearance of the vehicle 100.

Figure 1D:
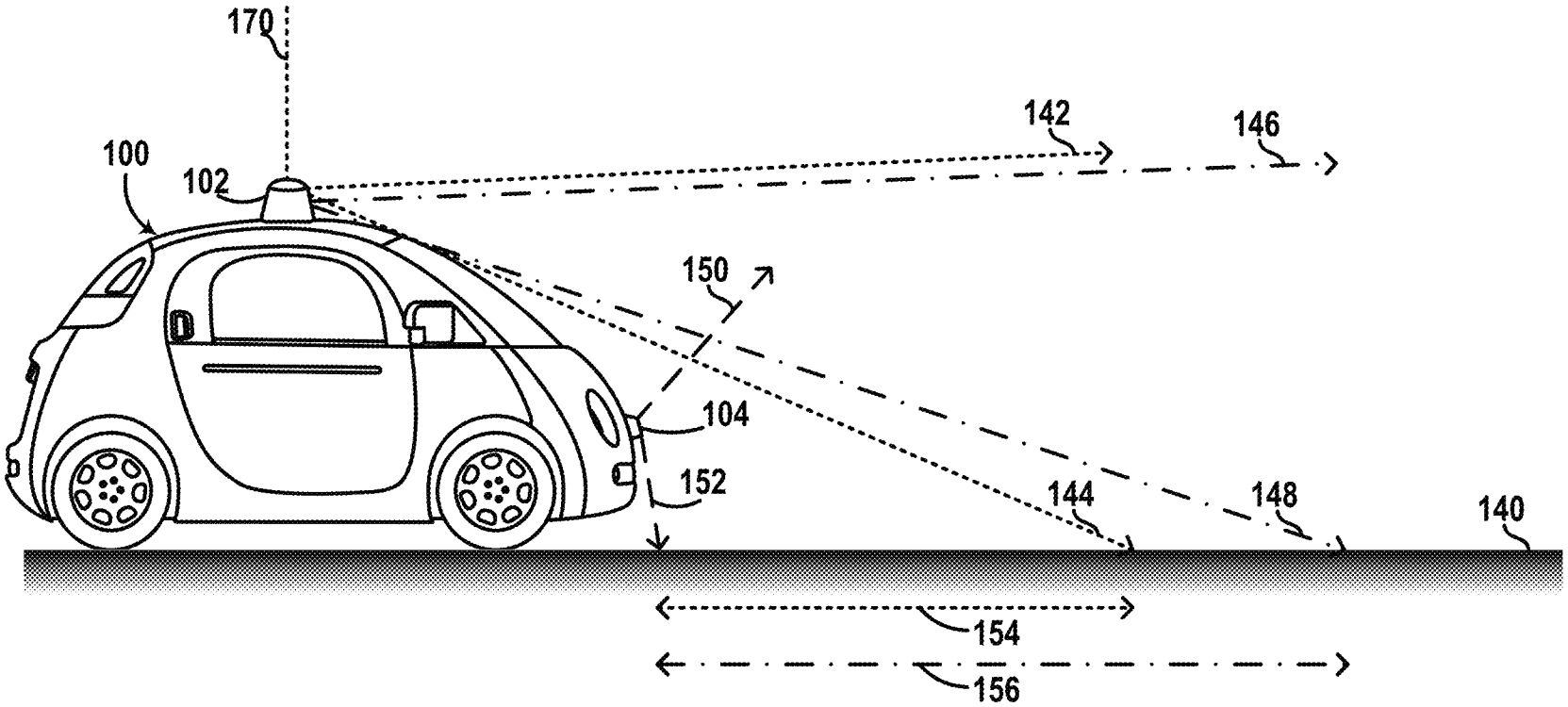
FIG. 1D illustrates in a side view the vehicle shown in FIG. 1A scanning a surrounding environment, according to an example embodiment.
Figure 1E:
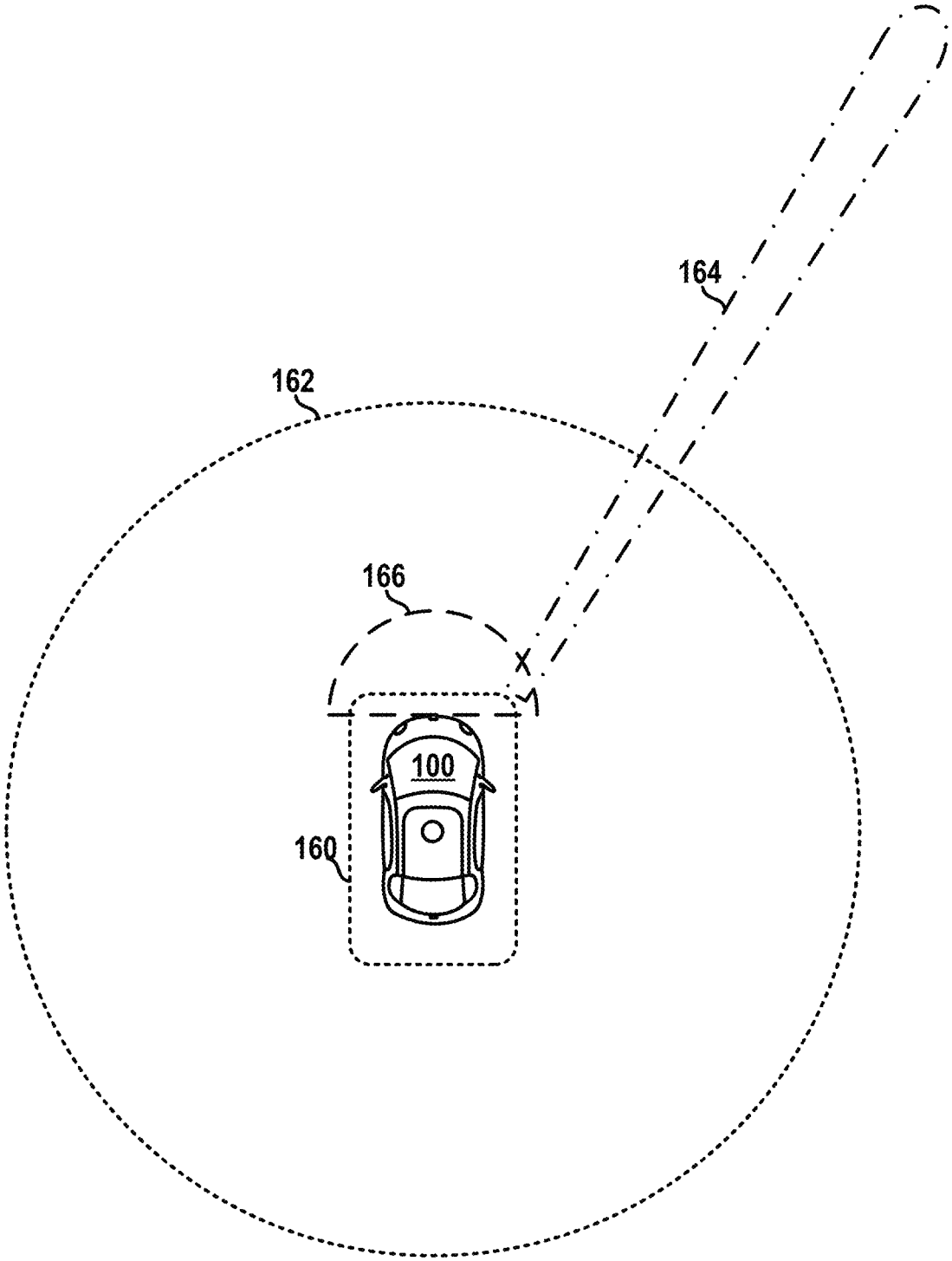
FIG. 1E illustrates in a top view the vehicle shown in FIG. 1A scanning a surrounding environment, according to an example embodiment.

FIGS. 1D and 1E illustrate the vehicle 100 shown in FIG. 1A scanning a surrounding environment, according to an example embodiment.

FIG. 1D illustrates a scenario where the vehicle 100 is operating on a surface 140. The surface 140, for example, may be a driving surface such as a road or a highway, or any other surface. In FIG. 1D, the arrows 142, 144, 146, 148, 150, 152 illustrate light pulses emitted by various LIDARs of the sensor units 102 and 104 at ends of the vertical FOV of the respective LIDAR.

By way of example, arrows 142 and 144 illustrate light pulses emitted by the first LIDAR 120 of FIG. 1B. In this example, the first LIDAR 120 may emit a series of pulses in the region of the environment between the arrows 142 and 144 and may receive reflected light pulses from that region to detect and/or identify objects in that region. Due to the positioning of the first LIDAR 120 (not shown) of the sensor unit 102 at the top side of the vehicle 100, the vertical FOV of the first LIDAR 120 is limited by the structure of the vehicle 100 (e.g., roof, etc.) as illustrated in FIG. 1D. However, the positioning of the first LIDAR 120 in the sensor unit 102 at the top side of the vehicle 100 allows the first LIDAR 120 to scan all directions around the vehicle 100 by rotating about a substantially vertical axis 170. Similarly, for example, the arrows 146 and 148 illustrate light pulses emitted by the second LIDAR 122 of FIG. 1B at the ends of the vertical FOV of the second LIDAR 122. Further, the second LIDAR 122 may also be steerable to adjust a viewing direction of the second LIDAR 122 to any direction around the vehicle 100 in line with the discussion. In one embodiment, the vertical FOV of the first LIDAR 120 (e.g., angle between arrows 142 and 144) is 20° and the vertical FOV of the second LIDAR 122 is 15° (e.g., angle between arrows 146 and 148). However, other vertical FOVs are possible as well depending, for example, on factors such as structure of the vehicle 100 or configuration of the respective LIDARs.

As shown in FIG. 1D, the sensor unit 102 (including the first LIDAR 120 and/or the second LIDAR 122) may scan for objects in the environment of the vehicle 100 in any direction around the vehicle 100 (e.g., by rotating, etc.), but may be less suitable for scanning the environment for objects in close proximity to the vehicle 100. For example, as shown, objects within distance 154 to the vehicle 100 may be undetected or may only be partially detected by the first LIDAR 120 of the sensor unit 102 due to positions of such objects being outside the region between the light pulses illustrated by the arrows 142 and 144. Similarly, objects within distance 156 may also be undetected or may only be partially detected by the second LIDAR 122 of the sensor unit 102.

Accordingly, the third LIDAR 130 (not shown) of the sensor unit 104 may be used for scanning the environment for objects that are close to the vehicle 100. For example, due to the positioning of the sensor unit 104 at the front side of the vehicle 100, the third LIDAR 130 may be suitable for scanning the environment for objects within the distance 154 and/or the distance 156 to the vehicle 100, at least for the portion of the environment extending away from the front side of the vehicle 100. As shown, for example, the arrows 150 and 152 illustrate light pulses emitted by the third LIDAR 130 at ends of the vertical FOV of the third LIDAR 130. Thus, for example, the third LIDAR 130 of the sensor unit 104 may be configured to scan a portion of the environment between the arrows 150 and 152, including objects that are close to the vehicle 100. In one embodiment, the vertical FOV of the third LIDAR 130 is 110° (e.g., angle between arrows 150 and 152). However, other vertical FOVs are possible as well.

It is noted that the angles between the various arrows 142-152 shown in FIG. 1D are not to scale and are for illustrative purposes only. Thus, in some examples, the vertical FOVs of the various LIDARs may vary as well.

FIG. 1E illustrates a top view of the vehicle 100 in a scenario where the vehicle 100 is scanning a surrounding environment. In line with the discussion above, each of the various LIDARs of the vehicle 100 may have a particular resolution according to its respective refresh rate, FOV, or any other factor. In turn, the various LIDARs may be suitable for detection and/or identification of objects within a respective range of distances to the vehicle 100.

As shown in FIG. 1E, contours 160 and 162 illustrate an example range of distances to the vehicle 100 where objects may be detected/identified based on data from the first LIDAR 120 of the sensor unit 102. As illustrated, for example, close objects within the contour 160 may not be properly detected and/or identified due to the positioning of the sensor unit 102 on the top side of the vehicle 100. However, for example, objects outside of contour 160 and within a medium range of distances (e.g., 100 meters, etc.) defined by the contour 162 may be properly detected/identified using the data from the first LIDAR 120. Further, as shown, the horizontal FOV of the first LIDAR 120 may span 360° in all directions around the vehicle 100.

Further, as shown in FIG. 1E, contour 164 illustrates a region of the environment where objects may be detected and/or identified using the higher resolution data from the second LIDAR 122 of the sensor unit 102. As shown, the contour 164 includes objects further away from the vehicle 100 within a long range of distances (e.g., 300 meters, etc.), for example. Although the contour 164 indicates a narrower FOV (horizontally) of the second LIDAR 122, in some examples, the vehicle 100 may be configured to adjust the viewing direction of the second LIDAR 122 to any other direction than that shown in FIG. 1E. By way of example, the vehicle 100 may detect an object using the data from the first LIDAR 120 (e.g., within the contour 162), adjust the viewing direction of the second LIDAR 122 to a FOV that includes the object, and then identify the object using the higher resolution data from the second LIDAR 122. In one embodiment, the horizontal FOV of the second LIDAR 122 may be 8°.

Further, as shown in FIG. 1E, contour 166 illustrates a region of the environment scanned by the third LIDAR 130 of the sensor unit 104. As shown, the region illustrated by the contour 166 includes portions of the environment that may not be scanned by the first LIDAR 120 and/or the second LIDAR 124, for example. Further, for example, the data from the third LIDAR 130 has a resolution sufficient to detect and/or identify objects within a short distance (e.g., 30 meters, etc.) to the vehicle 100.

It is noted that the ranges, resolutions, and FOVs described above are for exemplary purposes only, and may vary according to various configurations of the vehicle 100. Further, the contours 160-166 shown in FIG. 1E are not to scale but are illustrated as shown for convenience of description.

Figure 2:
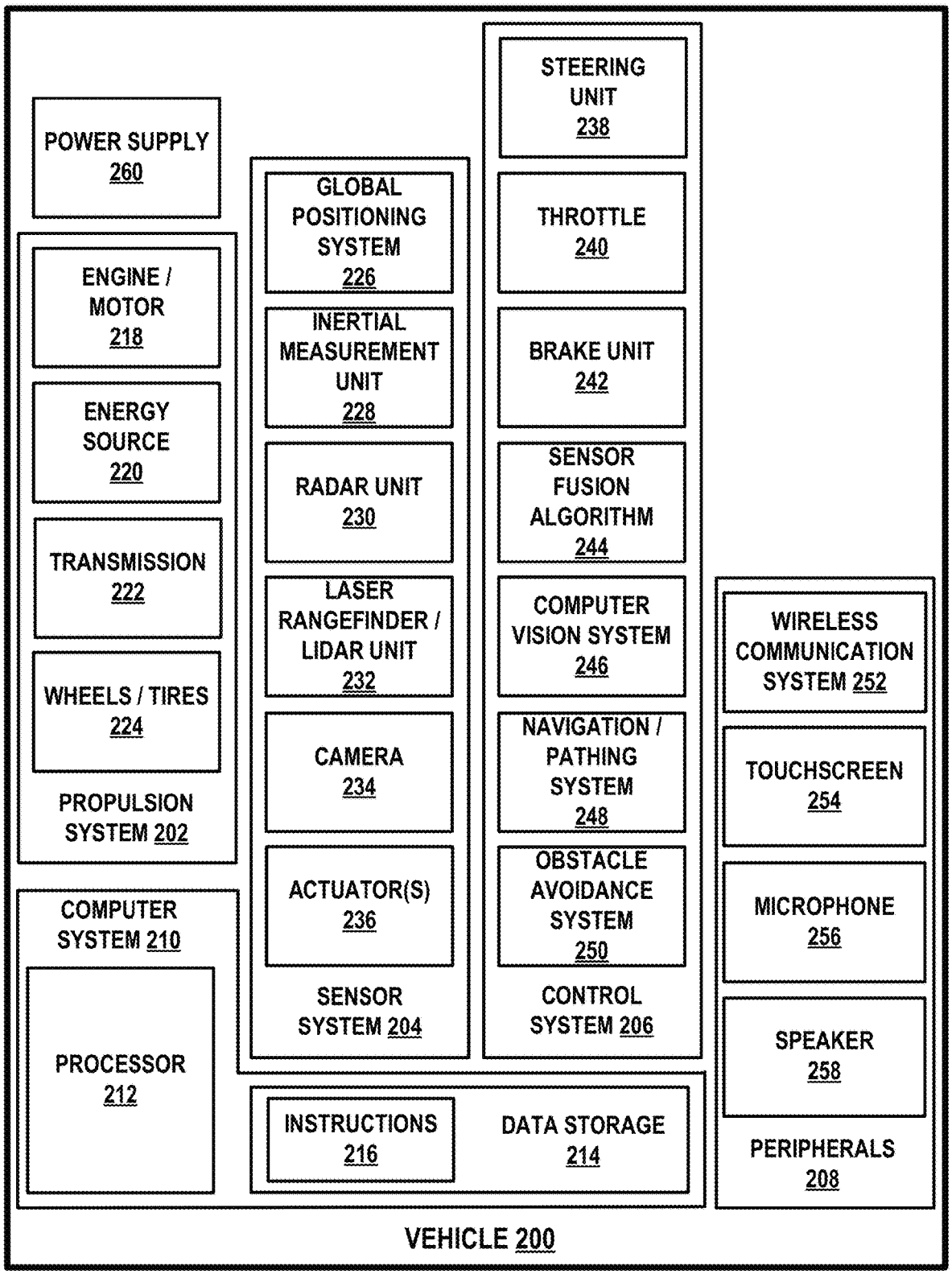
FIG. 2 is a simplified block diagram of a vehicle, according to an example embodiment.

FIG. 2 is a simplified block diagram of a vehicle 200, according to an example embodiment. The vehicle 200 may be similar to the vehicle 100, for example. As shown, the vehicle 200 includes a propulsion system 202, a sensor system 204, a control system 206, peripherals 208, and a computer system 210. In other embodiments, the vehicle 200 may include more, fewer, or different systems, and each system may include more, fewer, or different components. Additionally, the systems and components shown may be combined or divided in any number of ways.

The propulsion system 202 may be configured to provide powered motion for the vehicle 200. As shown, the propulsion system 202 includes an engine/motor 218, an energy source 220, a transmission 222, and wheels/tires 224.

The engine/motor 218 may be or include any combination of an internal combustion engine, an electric motor, a steam engine, and a Stirling engine. Other motors and engines are possible as well. In some embodiments, the propulsion system 202 may include multiple types of engines and/or motors. For instance, a gas-electric hybrid car may include a gasoline engine and an electric motor. Other examples are possible.

The energy source 220 may be a source of energy that powers the engine/motor 218 in full or in part. That is, the engine/motor 218 may be configured to convert the energy source 220 into mechanical energy. Examples of energy sources 220 include gasoline, diesel, propane, other compressed gas-based fuels, ethanol, solar panels, batteries, and other sources of electrical power. The energy source(s) 220 may additionally or alternatively include any combination of fuel tanks, batteries, capacitors, and/or flywheels. In some embodiments, the energy source 220 may provide energy for other systems of the vehicle 200 as well.

The transmission 222 may be configured to transmit mechanical power from the engine/motor 218 to the wheels/tires 224. To this end, the transmission 222 may include a gearbox, clutch, differential, drive shafts, and/or other elements. In embodiments where the transmission 222 includes drive shafts, the drive shafts may include one or more axles that are configured to be coupled to the wheels/tires 224.

The wheels/tires 224 of vehicle 200 may be configured in various formats, including a unicycle, bicycle/motorcycle, tricycle, or car/truck four-wheel format. Other wheel/tire formats are possible as well, such as those including six or more wheels. In any case, the wheels/tires 224 may be configured to rotate differentially with respect to other wheels/tires 224. In some embodiments, the wheels/tires 224 may include at least one wheel that is fixedly attached to the transmission 222 and at least one tire coupled to a rim of the wheel that could make contact with the driving surface. The wheels/tires 224 may include any combination of metal and rubber, or combination of other materials. The propulsion system 202 may additionally or alternatively include components other than those shown.

The sensor system 204 may include a number of sensors configured to sense information about an environment in which the vehicle 200 is located, as well as one or more actuators 236 configured to modify a position and/or orientation of the sensors. As shown, the sensors of the sensor system 204 include a Global Positioning System (GPS) 226, an inertial measurement unit (IMU) 228, a RADAR unit 230, a laser rangefinder and/or LIDAR unit 232, and a camera 234. The sensor system 204 may include additional sensors as well, including, for example, sensors that monitor internal systems of the vehicle 200 (e.g., an $O_2$ monitor, a fuel gauge, an engine oil temperature, etc.). Further, the sensor system 204 may include multiple LIDARs. In some examples, the sensor system 204 may be implemented as multiple sensor units each mounted to the vehicle in a respective position (e.g., top side, bottom side, front side, back side, right side, left side, etc.). Other sensors are possible as well.

The GPS 226 may be any sensor (e.g., location sensor) configured to estimate a geographic location of the vehicle 200. To this end, the GPS 226 may include a transceiver configured to estimate a position of the vehicle 200 with respect to the Earth. The GPS 226 may take other forms as well.

The IMU 228 may be any combination of sensors configured to sense position and orientation changes of the vehicle 200 based on inertial acceleration. In some embodiments, the combination of sensors may include, for example, accelerometers and gyroscopes. Other combinations of sensors are possible as well.

The RADAR unit 230 may be any sensor configured to sense objects in the environment in which the vehicle 200 is located using radio signals. In some embodiments, in addition to sensing the objects, the RADAR unit 230 may additionally be configured to sense the speed and/or heading of the objects.

Similarly, the laser range finder or LIDAR unit 232 may be any sensor configured to sense objects in the environment in which the vehicle 200 is located using lasers. In particular, the laser rangefinder or LIDAR unit 232 may include a laser source and/or laser scanner configured to emit a laser and a detector configured to detect reflections of the laser. The laser rangefinder or LIDAR 232 may be configured to operate in a coherent (e.g., using heterodyne detection) or an incoherent detection mode. In some examples, the LIDAR unit 232 may include multiple LIDARs that each have a unique position and/or configuration suitable for scanning a particular region of an environment around the vehicle 200.

The camera 234 may be any camera (e.g., a still camera, a video camera, etc.) configured to capture images of the environment in which the vehicle 200 is located. To this end, the camera may take any of the forms described above. The sensor system 204 may additionally or alternatively include components other than those shown.

The control system 206 may be configured to control operation of the vehicle 200 and its components. To this end, the control system 206 may include a steering unit 238, a throttle 240, a brake unit 242, a sensor fusion algorithm 244, a computer vision system 246, a navigation or pathing system 248, and an obstacle avoidance system 250.

The steering unit 238 may be any combination of mechanisms configured to adjust the heading of vehicle 200. The throttle 240 may be any combination of mechanisms configured to control the operating speed of the engine/motor 218 and, in turn, the speed of the vehicle 200. The brake unit 242 may be any combination of mechanisms configured to decelerate the vehicle 200. For example, the brake unit 242 may use friction to slow the wheels/tires 224. As another example, the brake unit 242 may convert the kinetic energy of the wheels/tires 224 to electric current. The brake unit 242 may take other forms as well.

The sensor fusion algorithm 244 may be an algorithm (or a computer program product storing an algorithm) configured to accept data from the sensor system 204 as an input. The data may include, for example, data representing information sensed at the sensors of the sensor system 204. The sensor fusion algorithm 244 may include, for example, a Kalman filter, a Bayesian network, an algorithm for some of the functions of the methods herein, or any another algorithm. The sensor fusion algorithm 244 may further be configured to provide various assessments based on the data from the sensor system 204, including, for example, evaluations of individual objects and/or features in the environment in which the vehicle 100 is located, evaluations of particular situations, and/or evaluations of possible impacts based on particular situations. Other assessments are possible as well.

The computer vision system 246 may be any system configured to process and analyze images captured by the camera 234 in order to identify objects and/or features in the environment in which the vehicle 200 is located, including, for example, traffic signals and obstacles. To this end, the computer vision system 246 may use an object recognition algorithm, a Structure from Motion (SFM) algorithm, video tracking, or other computer vision techniques. In some embodiments, the computer vision system 246 may additionally be configured to map the environment, track objects, estimate the speed of objects, etc.

The navigation and pathing system 248 may be any system configured to determine a driving path for the vehicle 200. The navigation and pathing system 248 may additionally be configured to update the driving path dynamically while the vehicle 200 is in operation. In some embodiments, the navigation and pathing system 248 may be configured to incorporate data from the sensor fusion algorithm 244, the GPS 226, the LIDAR unit 232, and one or more predetermined maps so as to determine the driving path for vehicle 200.

The obstacle avoidance system 250 may be any system configured to identify, evaluate, and avoid or otherwise negotiate obstacles in the environment in which the vehicle 200 is located. The control system 206 may additionally or alternatively include components other than those shown.

Peripherals 208 may be configured to allow the vehicle 200 to interact with external sensors, other vehicles, external computing devices, and/or a user. To this end, the peripherals 208 may include, for example, a wireless communication system 252, a touchscreen 254, a microphone 256, and/or a speaker 258.

The wireless communication system 252 may be any system configured to wirelessly couple to one or more other vehicles, sensors, or other entities, either directly or via a communication network. To this end, the wireless communication system 252 may include an antenna and a chipset for communicating with the other vehicles, sensors, servers, or other entities either directly or via a communication network. The chipset or wireless communication system 252 in general may be arranged to communicate according to one or more types of wireless communication (e.g., protocols) such as Bluetooth, communication protocols described in IEEE 802.11 (including any IEEE 802.11 revisions), cellular technology (such as GSM, CDMA, UMTS, EV-DO, WiMAX, or LTE), Zigbee, dedicated short range communications (DSRC), and radio frequency identification (RFID) communications, among other possibilities. The wireless communication system 252 may take other forms as well.

The touchscreen 254 may be used by a user to input commands to the vehicle 200. To this end, the touchscreen 254 may be configured to sense at least one of a position and a movement of a user's finger via capacitive sensing, resistance sensing, or a surface acoustic wave process, among other possibilities. The touchscreen 254 may be capable of sensing finger movement in a direction parallel or planar to the touchscreen surface, in a direction normal to the touchscreen surface, or both, and may also be capable of sensing a level of pressure applied to the touchscreen surface. The touchscreen 254 may be formed of one or more translucent or transparent insulating layers and one or more translucent or transparent conducting layers. The touchscreen 254 may take other forms as well.

The microphone 256 may be configured to receive audio (e.g., a voice command or other audio input) from a user of the vehicle 200. Similarly, the speakers 258 may be configured to output audio to the user of the vehicle 200. The peripherals 208 may additionally or alternatively include components other than those shown.

The computer system 210 may be configured to transmit data to, receive data from, interact with, and/or control one or more of the propulsion system 202, the sensor system 204, the control system 206, and the peripherals 208. To this end, the computer system 210 may be communicatively linked to one or more of the propulsion system 202, the sensor system 204, the control system 206, and the peripherals 208 by a system bus, network, and/or other connection mechanism (not shown).

In one example, the computer system 210 may be configured to control operation of the transmission 222 to improve fuel efficiency. As another example, the computer system 210 may be configured to cause the camera 234 to capture images of the environment. As yet another example, the computer system 210 may be configured to store and execute instructions corresponding to the sensor fusion algorithm 244. As still another example, the computer system 210 may be configured to store and execute instructions for determining a 3D representation of the environment around the vehicle 200 using the LIDAR unit 232. Other examples are possible as well.

As shown, the computer system 210 includes the processor 212 and data storage 214. The processor 212 may comprise one or more general-purpose processors and/or one or more special-purpose processors. To the extent the processor 212 includes more than one processor, such processors could work separately or in combination. Data storage 214, in turn, may comprise one or more volatile and/or one or more non-volatile storage components, such as optical, magnetic, and/or organic storage, and data storage 214 may be integrated in whole or in part with the processor 212.

In some embodiments, data storage 214 may contain instructions 216 (e.g., program logic) executable by the processor 212 to execute various vehicle functions (e.g., methods 500-700, etc.). Data storage 214 may contain additional instructions as well, including instructions to transmit data to, receive data from, interact with, and/or control one or more of the propulsion system 202, the sensor system 204, the control system 206, and/or the peripherals 208. The computer system 210 may additionally or alternatively include components other than those shown.

As shown, the vehicle 200 further includes a power supply 260, which may be configured to provide power to some or all of the components of the vehicle 200. To this end, the power supply 260 may include, for example, a rechargeable lithium-ion or lead-acid battery. In some embodiments, one or more banks of batteries could be configured to provide electrical power. Other power supply materials and configurations are possible as well. In some embodiments, the power supply 260 and energy source 220 may be implemented together as one component, as in some all-electric cars.

In some embodiments, the vehicle 200 may include one or more elements in addition to or instead of those shown. For example, the vehicle 200 may include one or more additional interfaces and/or power supplies. Other additional components are possible as well. In such embodiments, data storage 214 may further include instructions executable by the processor 212 to control and/or communicate with the additional components.

Still further, while each of the components and systems are shown to be integrated in the vehicle 200, in some embodiments, one or more components or systems may be removably mounted on or otherwise connected (mechanically or electrically) to the vehicle 200 using wired or wireless connections. The vehicle 200 may take other forms as well.

In some embodiments, as noted above, the vehicle 200 may rotate one or more components, such as one or more of the sensors in the sensor system 204 and/or one or more of the peripherals 208, among other possibilities. Referring back to FIG. 1E by way of example, the vehicle 100 scans portions of the environment illustrated by contours 162-166 by rotating respective sensors of the sensor units 102-110. Similarly, the vehicle 200 in some embodiments may mount one or more of its various components on respective rotating platforms to adjust directions of the various components.

Figure 3:
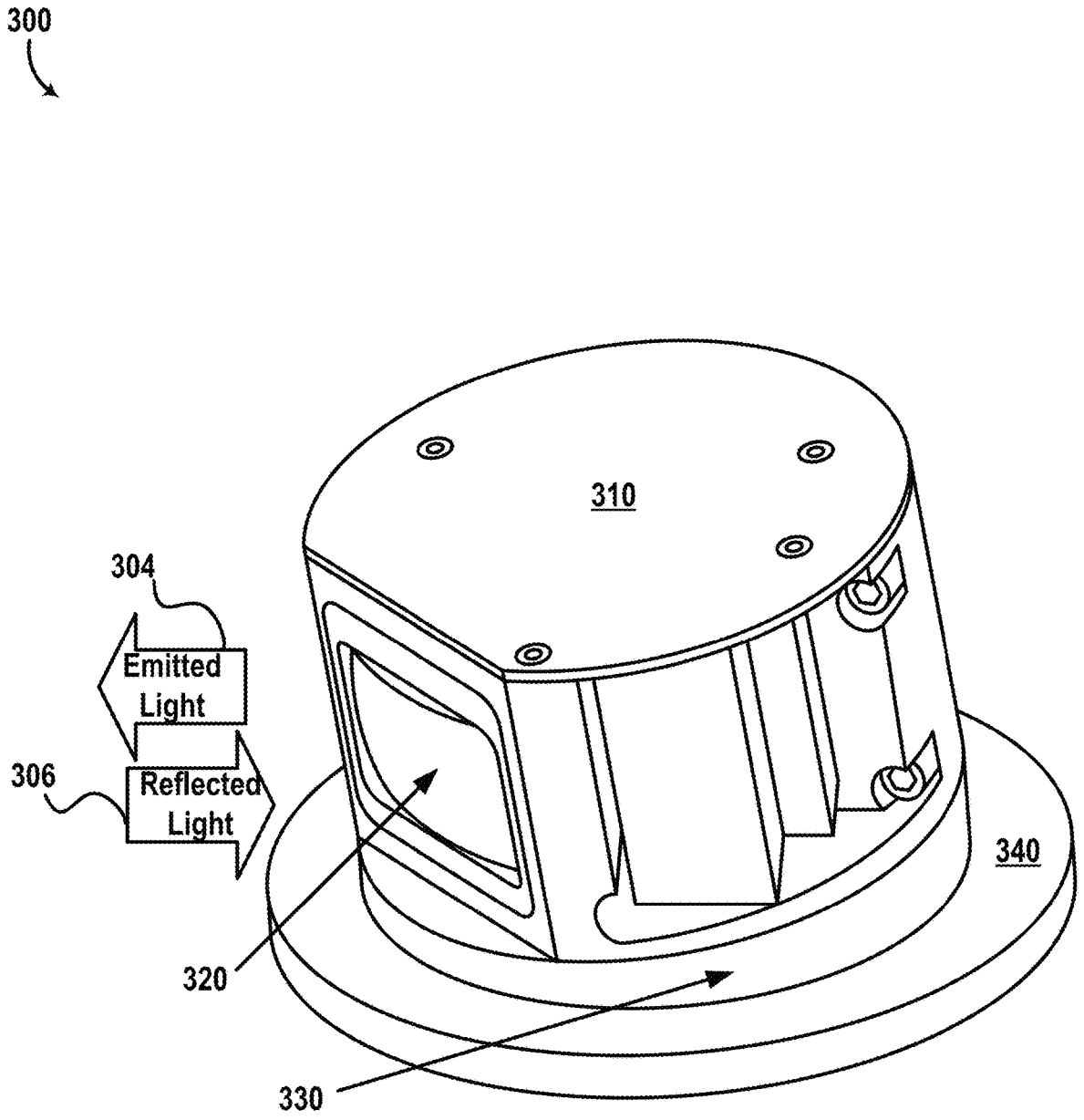
FIG. 3 illustrates a LIDAR device, according to an example embodiment.

For example, FIG. 3 illustrates a LIDAR device 300, according to an example embodiment. In some examples, the LIDAR 300 may be similar to the LIDARs 120-122 of FIG. 1B, the LIDAR 130 of FIG. 1C, the LIDAR(s) of the LIDAR unit 232, and/or any other LIDAR device mounted to a vehicle such as the vehicles 100, 200. As shown, the LIDAR device 300 includes a housing 310 and a lens 320. Additionally, light beams 304 emitted by the LIDAR device 300 propagate from the lens 320 along a viewing direction of the LIDAR 300 toward an environment of the LIDAR device 300, and may reflect off one or more objects in the environment as reflected light 306.

The housing 310 included in the LIDAR device 310 can house the various components included in the LIDAR device 300. The housing 310 can be formed from any material capable of supporting the various components of the LIDAR device 300 included in an interior space of the housing 310. For example, the housing 310 may be formed from a solid material such as plastic or metal among other possibilities.

In some examples, the housing 310 can be configured to have a substantially cylindrical shape and to rotate about an axis of the LIDAR device 300. For example, the housing 310 can have the substantially cylindrical shape with a diameter of approximately 10 centimeters. In some examples, the axis is substantially vertical. By rotating the housing 210 that includes the various components, in some examples, a three-dimensional map of a 360-degree view of the environment of the LIDAR device 300 can be determined without frequent recalibration of the arrangement of the various components of the LIDAR device 300. Additionally or alternatively, in some examples, the LIDAR device 300 can be configured to rotate less than a complete rotation to allow scanning a portion of the environment that is less than a 360-degree view (e.g., contours 164, 166 of FIG. 1E). Additionally or alternatively, in some examples, the LIDAR device 300 can be configured to tilt the axis of rotation of the housing 310 to control the field of view of the LIDAR device 300.

The lens 320 mounted to the housing 310 can have an optical power to both collimate the emitted light beams 304, and/or focus the reflected light 306 from one or more objects in the environment of the LIDAR device 300 onto detectors in the LIDAR device 300. In one example, the lens 320 has a focal length of approximately 120 mm. In some examples, where the same lens 320 is used to perform both collimation and receiving of light 304-306, instead of a transmit lens for collimating and a receive lens for focusing, advantages with respect to size, cost, and/or complexity can be provided.

The LIDAR device 300 also includes a rotor platform 330 and a stator platform 340. Various rotating components of the LIDAR device 300, such as the lens 320 and other components inside the housing 310, can be mounted on that rotor platform 330 that rotates relative to the stator platform 340 to provide a 360-degree view (or less) of the environment surrounding the LIDAR device 300. In one example, the stator platform 340 can be coupled to a side of a vehicle, similarly to the sensor units 102-110 of vehicle 100, and the rotor platform 330 may rotate relative to the stator platform 340 to adjust the directions of the emitted light 304 to scan various portions of an environment around the vehicle (e.g., the portions of the environment illustrated by contours 162-164 of FIG. 1E, etc.).

III. ILLUSTRATIVE ROTARY JOINT CONFIGURATIONS

Within examples, a rotary joint may be configured as a communication interface between two structures of an electromechanical system, in which one or both of the two structures is configured to rotate relative to the other structure. To that end, in some example implementations herein, a portion of the rotary joint may be coupled to one structure of the example system and another portion may be coupled to the other structure of the example system. For instance, referring back to FIG. 3, an example rotary joint may be configured as an interface between the rotor platform 330 and the stator platform 340 such that a portion of the rotary joint is included in the rotor platform 330 and another portion of the rotary joint is included in the stator platform 340. Additionally or alternatively, in some example implementations, the rotary joint may be included within a structure arranged between two structures that rotate with respect to one another. For instance, in an example system that includes a robotic joint that couples two robotic links, the rotary joint may be disposed within the robotic joint to facilitate signal communication between the two robotic links. Other example implementations are possible as well in line with the discussion above.

Figure 4:
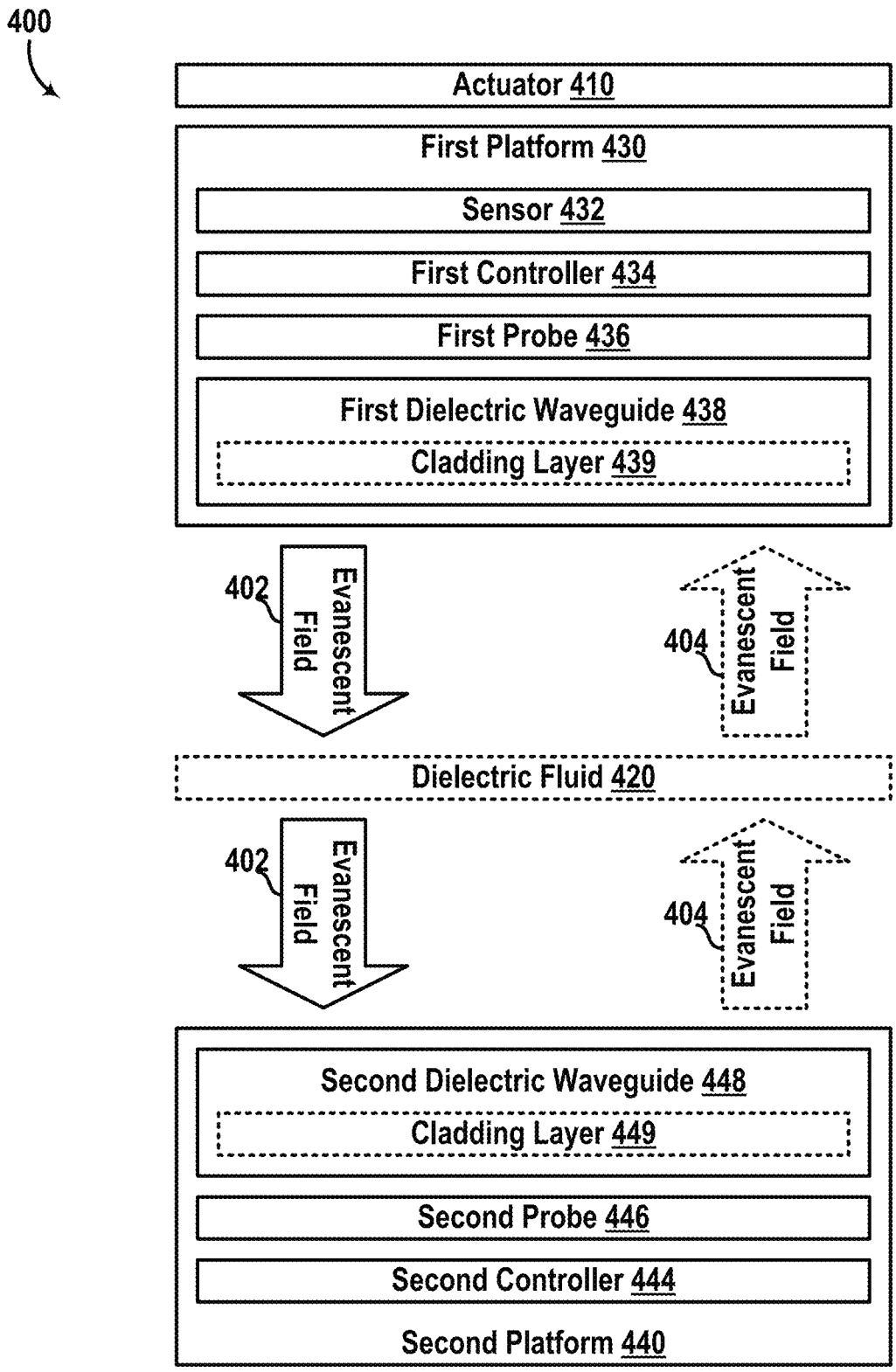
FIG. 4 is a simplified block diagram of a device that includes a rotary joint, according to an example embodiment.

FIG. 4 is a simplified block diagram of a device 400 that includes a rotary joint, according to an example embodiment. In some examples, the device 400 can be used with an electromechanical system, such as any of the vehicles 100 and 200, or any other electromechanical system in line with the discussion above. In some examples, the device 400 may be similar to the LIDAR devices 120, 122, 130, 300, and/or any of the components of the vehicles 100-200 that include a moveable component.

As shown, the device 400 includes an actuator 410, a first platform 430, and a second platform 440. In some examples, the device 400 may also include a dielectric fluid 420.

The actuator 410 may be similar to the actuator(s) 236 of the vehicle 200. In some examples, the actuator 410 may be configured to cause a relative rotation between the first platform 430 (or one or more components thereof) and the second platform 440 (or one or more components thereof). To that end, for example, the actuator 410 may be coupled to one or both of the platforms 430, 440 (or one or more components thereof) to cause the relative rotation.

The first platform 430 may be similar to the rotor platform 330 and/or the stator platform 340 of the device 300. As shown, the first platform 430 includes a sensor 432, a first controller 434, a first probe 436, and a first dielectric waveguide 438. Thus, in one example, similarly to the rotor platform 330 of the device 300, the first platform 430 may be rotated (e.g., by the actuator 410, etc.) about an axis to adjust a viewing direction of the sensor 432.

The sensor 432 may include any sensor, such as one or more sensors of the sensor system 204 of the vehicle 200, one or more of the sensors included in the vehicle 100, and/or the sensor(s) included in the device 300, among other possibilities.

The first controller 434 may be coupled to various components of the first platform 430 and configured to operate one or more of the various components. The first controller 434 may include any combination of general-purpose processors, specific-purpose processors, data storage, logic circuitry, and/or any other circuitry configured to operate one or more components of the device 400. For instance, similarly to the computer system 210 of the vehicle 200, the first controller 434 may include one or more processors that execute instructions stored in a data storage (e.g., similar to data storage 214) to operate the sensor 432 and/or the first probe 436 in line with the discussion above. In one example, the first controller 434 may be configured to receive data from the sensor 432 and to provide a modulated signal indicative of the data to the first probe 436. For instance, the data may be indicative of a scan of an environment of the device 400 by the sensor 432, a representation of sounds detected by the sensor 432, and/or any other sensor output of the sensor 432.

The first probe 436 may include an antenna, a transmitter, a receiver, a transceiver, and/or any other circuitry configured to modulate and/or emit RF waves for propagation inside the first dielectric waveguide 438. In some examples, the first probe 436 may also be configured to receive RF waves propagating inside the first dielectric waveguide 438, and to provide a first-probe signal to the first controller 434 indicative of the received RF waves. In one example, the RF waves received by the first probe 436 may be indicative of instructions for operating the sensor 432 and/or any other component of the device 400 (e.g., actuator 410, etc.).

The first dielectric waveguide 438 may comprise any combination of dielectric materials (e.g., acrylics, acrylic polymers, non-acrylic dielectric materials, etc.) that have material characteristics (e.g., dimensions, material types, etc.) suitable for guiding propagation of RF waves inside the first dielectric waveguide 438. For instance, the first dielectric waveguide 438 may have a particular dimension and a particular shape that is suitable for supporting one or more propagating-wave modes (e.g., transverse electric (TE) modes, transverse magnetic (TM) modes, transverse electromagnetic (TEM) modes, hybrid modes, etc.) for a particular RF bandwidth of RF waves emitted/received by the first probe 436. In one embodiment, the first dielectric waveguide 438 comprises an acrylic material having square cross-section dimensions of 100 millimeters×100 millimeters. However, other dimensions and shapes are possible as well in accordance with characteristics of the RF waves emitted by the first probe 436 and/or characteristics of the first platform 430 (or components thereof). For instance, referring back to FIG. 3 by way of example, the first dielectric waveguide 438 may have a substantially circular-arc shape in accordance with a shape of the rotor platform 330, which is also suitable for the propagation of the RF waves emitted by the first probe 436.

In line with the discussion above, the first dielectric waveguide 438 may also include a first side (not shown) configured to emit an evanescent field 402 towards the second platform 440 (or components thereof). The evanescent field 402 may be associated with the RF waves (e.g., emitted by the first probe 436, etc.) propagating inside the first dielectric waveguide 438. For instance, the evanescent field 402 may be emitted in response to internal reflection of the RF waves at the first side, as the first dielectric waveguide guides the propagation of the RF waves.

In some examples, the first dielectric waveguide 438 may optionally include a cladding layer 439 disposed on at least one side (not shown) of the first dielectric waveguide 438 other than the first side (not shown) that is emitting the evanescent field 402. The cladding layer 439, for example, may include any material (e.g., a dielectric material, etc.) having material characteristics suitable for increasing an extent of the internal reflection of the RF waves at the at least one side of the first dielectric waveguide 438. For example, the cladding layer 439 may comprise an acrylic polymer (or other non-acrylic dielectric material, etc.) that has a particular index of refraction that reduces a portion of energy from the RF waves evanescing from the at least one side where the cladding layer 439 is disposed. As a result, for example, a larger portion of the energy from the RF waves may evanesce as the evanescent field 402 at the first side that is positioned adjacent to the second platform 440.

In some examples, the device 400 may optionally include a dielectric fluid 420 interposed between the first platform 430 (or components thereof) and the second platform 440 (or components thereof). For example, the dielectric fluid 420 may include any combination of gases (e.g., air, etc.), liquids, plasmas, or any other fluid that are associated with a low attenuation coefficient for RF waves within the particular RF bandwidth (and/or any other RF wave characteristic) associated with the first probe 436. As a result, for example, the dielectric fluid 420 may increase an extent of the evanescent field 402 emitted by the first dielectric waveguide 438 towards the second platform 440. However, in some examples, the device 400 may be alternatively implemented without the dielectric fluid 420. In one example, the waveguides 438 and 448 may be included in a vacuum chamber. Thus, in this example, the evanescent field 402 (and/or 404) may propagate in vacuum. Other examples are possible as well.

The second platform 440 may be similar to the rotor platform 330 and/or the stator platform 340 of the device 300. As shown, the second platform 440 includes a second controller 444, a second probe 446, and a second dielectric waveguide 448. Thus, in one example, similarly to the stator platform 340 of the device 300, the second platform 440 may be positioned adjacent to the first platform 430. And the second platform 440 may be positioned at least partially within the evanescent field 402 from the first platform 430.

The second controller 444 may include any combination of processors, logic circuitry, etc., similarly to the first controller 434. Like the first controller 434, the second controller 444 may be coupled to the second probe 446 and configured to receive a second-probe signal from the second probe 446 indicative of RF waves received by the second probe 446. In one example, the second controller 444 may be configured to demodulate the second-probe signal from the second probe 446, and to determine the data from the sensor 432 based on the demodulated signal.

Like the first probe 436, the second probe 446 may include an antenna, a transmitter, a receiver, a transceiver, and/or any other circuitry. The second probe 446 may be configured to receive RF waves propagating inside the second dielectric waveguide 448, and to provide the second-probe signal to the second controller 444 indicative of the received RF waves. For example, the RF waves received by the second probe 446 may be indicative of the data from the sensor 432. Additionally or alternatively, in some examples, the second probe 446 may also be configured to modulate and/or emit RF waves for propagation inside the second dielectric waveguide 448. For example, the RF waves emitted by the second probe 446 may be indicative of instructions for operating the sensor 432 and/or any other component of the device 400 (e.g., actuator 410, etc.).

The second dielectric waveguide 448 may comprise dielectric materials similarly to the first dielectric waveguide 438, and configured to support propagation of RF waves inside the second dielectric waveguide 448. Further, in some examples, the second dielectric waveguide 448 may optionally include a cladding layer 449, similar to the cladding layer 439, that is disposed on at least one side (not shown) of the second dielectric waveguide 448 other than a second side (not shown) that is adjacent to the first side (not shown) of the first dielectric waveguide 438 emitting the evanescent field 402.

In line with the discussion above, the second side of the second dielectric waveguide 448 may be positioned at a predetermined distance to the first side of the first dielectric waveguide 438 emitting the evanescent field 402. As a result, for example, the evanescent field 402 may couple with the second dielectric waveguide 448 to induce propagation of induced RF waves inside the second dielectric waveguide 448. Thus, the first probe 436 may communicate with the second probe 448 via a wireless communication path that includes, in this order: the RF waves emitted by the first probe 436 into the first dielectric waveguide 438, the evanescent field 402 emitted by the first dielectric waveguide 438, and the induced RF waves (associated with the evanescent field 402) that are propagating inside the second dielectric waveguide 448.

Similarly, in some examples, the second probe 446 may also communicate with the first probe 436 via a wireless communication path that includes, in this order: RF waves emitted by the second probe 446 into the second dielectric waveguide 448, an evanescent field 404 associated with the RF waves (emitted by the second probe 446) propagating inside the second dielectric waveguide 448, and induced RF waves (associated with the evanescent field 404) that are propagating inside the first dielectric waveguide 438.

In some embodiments, the device 400 may include one or more elements in addition to or instead of those shown. For example, the first platform 430 may include one or more additional components such as a speaker, a display, or any other component (e.g., peripherals 208 of the vehicle 200). Other additional or alternative components are possible as well. In such embodiments, the controllers 434 and 444 may also be configured to operate such components and/or to facilitate communication between such components and other components of the device 400 (and beyond) via the dielectric waveguides 438 and 448.

Still further, while each of the components and systems are shown to be integrated in the device 400, in some embodiments, one or more components may be removably mounted on or otherwise connected (mechanically or electrically) to the device 400 using wired or wireless connections. For example, the first dielectric waveguide 438 may be alternatively positioned outside the first platform 430 (e.g., mechanically disposed at the bottom of rotor platform 330 of FIG. 3, etc.), or the two dielectric waveguides 438, 448 may be alternatively arranged in any different arrangement that maintains the predetermined distance between the two waveguides 438, 448. The device 400 may take other forms as well.

Figure 5A:
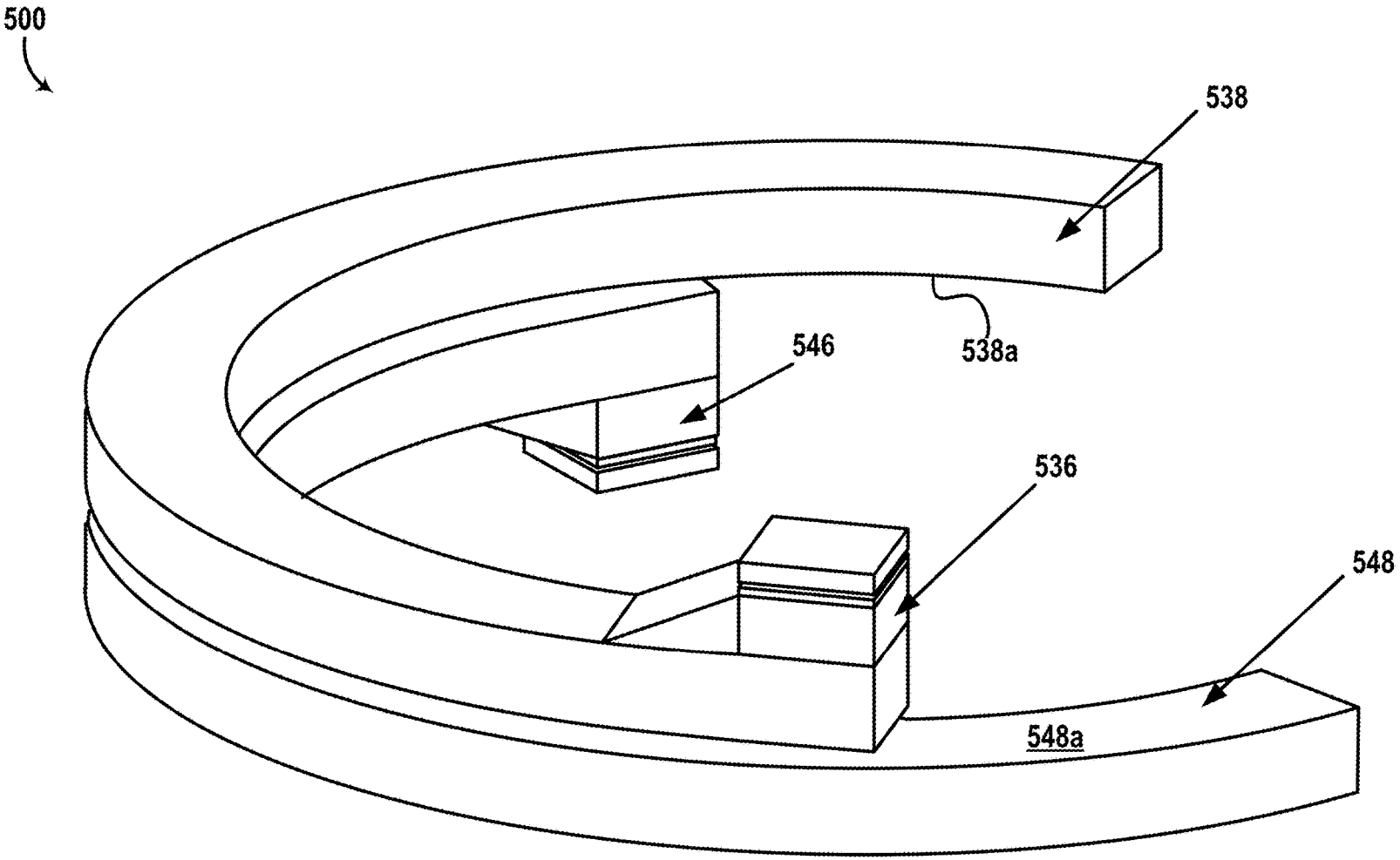
FIG. 5A illustrates a device, according to an example embodiment.

FIG. 5A illustrates a device 500, according to an example embodiment. The device 500 may be similar to the devices 120, 122, 130, 300, and/or 400, and may be used with an electromechanical system such as the vehicles 100, 200, among other possibilities.

As shown, the device 500 includes a first probe 536, a first dielectric waveguide 538, a second probe 546, and a second dielectric waveguide 548 that are similar, respectively, to the first probe 436, the first dielectric waveguide 438, the second probe 446, and the second dielectric waveguide 448 of the device 400. Although not shown in FIG. 5, in some examples, the device 500 may include additional components such as one or more of the components of the device 400 (e.g., controllers, sensors, actuators, etc.). It is noted that the shapes and dimensions shown in FIG. 5A for the various components of the device 500 are for illustrative purposes only. The device 500 may take other forms, shapes, and/or dimensions as well.

As shown, the first dielectric waveguide 538*a* has a first side 538*a* that is positioned at a predetermined distance to a second side 548*a* of the second dielectric waveguide 548. Thus, in line with the discussion above for FIG. 4, an evanescent field (e.g., evanescent field 402, etc.) emitted by the first side 538*a* of the first dielectric waveguide 538 towards the second side 548*a* may couple with the second dielectric waveguide 548 to induce propagation of induced RF waves inside the second dielectric waveguide 548 for receipt by the second probe 546.

In line with the discussion above, the device 500 may provide a communication interface for a moveable component of an electromechanical system. For example, referring back to FIG. 3, the first probe 536 and the first dielectric waveguide 538 may be coupled to (or disposed within) the rotor platform 330. Further, in this example, the second probe 546 and the second dielectric waveguide 548 may be coupled to (or disposed within) the stator platform 340. However, other arrangements and implementations of the device 500 are possible as well in accordance with the present disclosure.

As noted above, the dimensions of the various components of the device 500 may vary in accordance with characteristics of the RF waves propagating inside the respective waveguides 538, 548, as well as other factors pertaining to the system which uses the device 500. In one embodiment, the waveguides 538, 548 each have square cross-section dimensions of approximately 100 millimeters× 100 millimeters, and the predetermined distance between the first side 538*a* and the second side 548*a* is approximately 10 millimeters. However, other dimensions and/or distances are possible as well.

Further, in some examples, the predetermined distance (e.g., 10 millimeters) between the respective sides 538*a*, 548*b* may be based on various factors such as material characteristics of the waveguides 538, 548, material characteristics of the fluid in the gap between the sides 538*a*, 54*b*, and/or electromagnetic characteristics of the RF waves emitted/received by the probes 536, 546.

In one example, the waveguides 538, 548 may be formed from a dielectric material (e.g., acrylic material, non-acrylic material, etc.) that is suitable for a threshold high portion of energy to evanesce at the first side 538*a*, and thus the predetermined distance of 10 millimeters may be appropriate for such material. On the other hand, for example, other materials (e.g., metals, etc.) may allow a smaller portion of the energy to evanesce at the first side 538*a*, and thus a smaller predetermined distance may be used between the sides 538*a*, 548*a*.

In another example, a dielectric fluid (e.g., plasma, gas, etc.) may be interposed (not shown) in the gap between the first sides 538*a*, 548*a* that has a lower attenuation coefficient than air for RF waves having characteristics (e.g., frequencies, polarizations, etc.) associated with the probes 536, 546. As a result, for example, the predetermined distance between the sides 538*a*, 548*a* may be greater than 10 millimeters. Other examples are possible as well.

Further, as shown, the first side 538*a* of the first waveguide 538 has a curved shape, and the second side 548*a* of the second waveguide 548 has a corresponding curved shape. In some examples, as shown, the first side 538*a* may be substantially parallel to the second side 548*a*. In these examples, the curved shape of the first side 538*a* may be a substantially circular-arc shape (as shown), and the curved shape of the second side 548*a* may be a corresponding substantially circular-arc shape (as shown). Thus, in these examples, in response to a relative rotation between the waveguides 538 and 548, the first side 538*a* may remain within the predetermined distance to the second side 548*a* based on an overlap (as shown) between the substantially circular-arc shape of the first side 538*a* and the corresponding substantially circular-arc shape of the second side 548*a*, and based also on the first side 538*a* and the second side 548*a* being substantially parallel. For instance, the waveguides 538 and 548 may be arranged concentrically (as shown) about a common axis of the circular-arc shaped and parallel sides 538*a* and 548*a*. In this instance, rotation of either waveguide of the waveguides 538 and 548 about the common axis may maintain, at least partially, an overlap between the sides 538*a* and 548*a* separated by (approximately) the same predetermined distance. However, the device 500 may take other forms or shapes as well that also allow at least a partial overlap between sides 538*a* and 538*b* as one or both of the respective waveguides 538 and 548 rotate relative to each other.

Figure 5B:
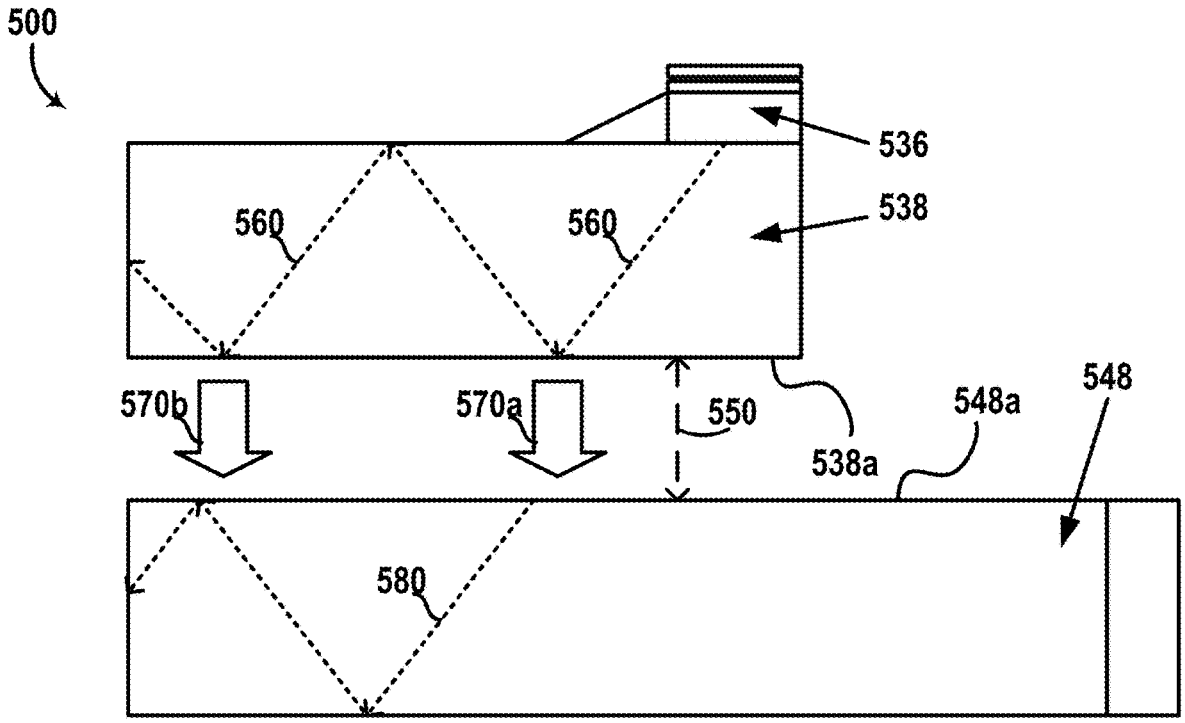
FIG. 5B illustrates the device of FIG. 5A in operation, according to an example embodiment.
Figure 5C:
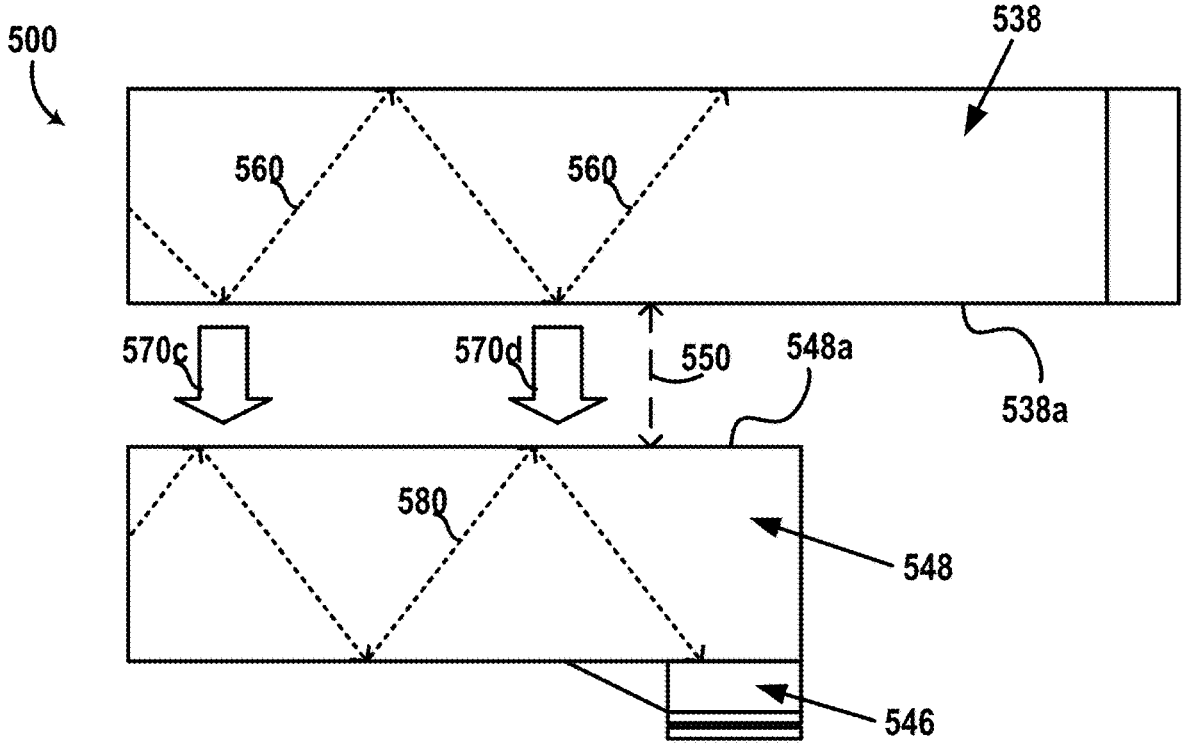
FIG. 5C illustrates the device of FIG. 5A in operation, according to an example embodiment.

FIGS. 5B and 5C illustrate side views of the device 500 shown in FIG. 5A while in operation, according to an example embodiment. It is noted that relative dimensions of the various components of the device 500 as shown in FIGS. 5B and 5C are not to scale, but are illustrated as shown for convenience in description. As shown, the first side 538*a* and the second side 548*a* are separated by predetermined distance 550. In some embodiments, as shown, the first side 538*a* is substantially parallel to the second side 548*a*.

FIGS. 5B and 5C illustrate an example scenario for an operation of the device 500, in line with the discussion above. In the scenario, as shown in FIG. 5B, the first probe 536 emits RF waves 560 into the first dielectric waveguide 538. The waveguide 538 guides propagation of the RF waves 560 inside the waveguide 538. For instance, as shown, the RF waves 560 may reflect off one or more sides of the waveguide 538, including the first side 538*a*. As a result of the internal reflections of the RF waves 560, an evanescent field (illustrated by arrows 570*a*-570*b*) is emitted by the first side 538*a* towards the second side 548*a* of the second waveguide 548. In the scenario, the evanescent field 570*a-b* couples with the second waveguide 548 to cause propagation of induced RF waves 580.

Continuing with the scenario, as shown in FIG. 5C, the first waveguide 538 continues to guide propagation of the RF waves 560 inside the first waveguide 538. And, in the scenario, the first side 538*a* continues to emit the evanescent field (illustrated by arrows 570*c*-570*d*). And, in the scenario, the second waveguide 548 continues to guide the induced RF waves 580 (associated with the evanescent field 570*a*-570*d*) propagating inside the second waveguide 548 towards the second probe 546. Next, in the scenario, the second probe 546 receives the induced RF waves 580.

Thus, through this process described in the example scenario, the first probe 536 may wirelessly communicate with the second probe 546 by modulating the emitted RF waves 560. Additionally, by using the two waveguides 538, 548, the device 500 allows for a substantially stable wireless communication interface between the probes 536, 546 that is less susceptible to relative motion between the two probes 536, 546 as the respective waveguides 536, 548 rotate relative to one another (as shown in FIG. 5A).

Figure 6:
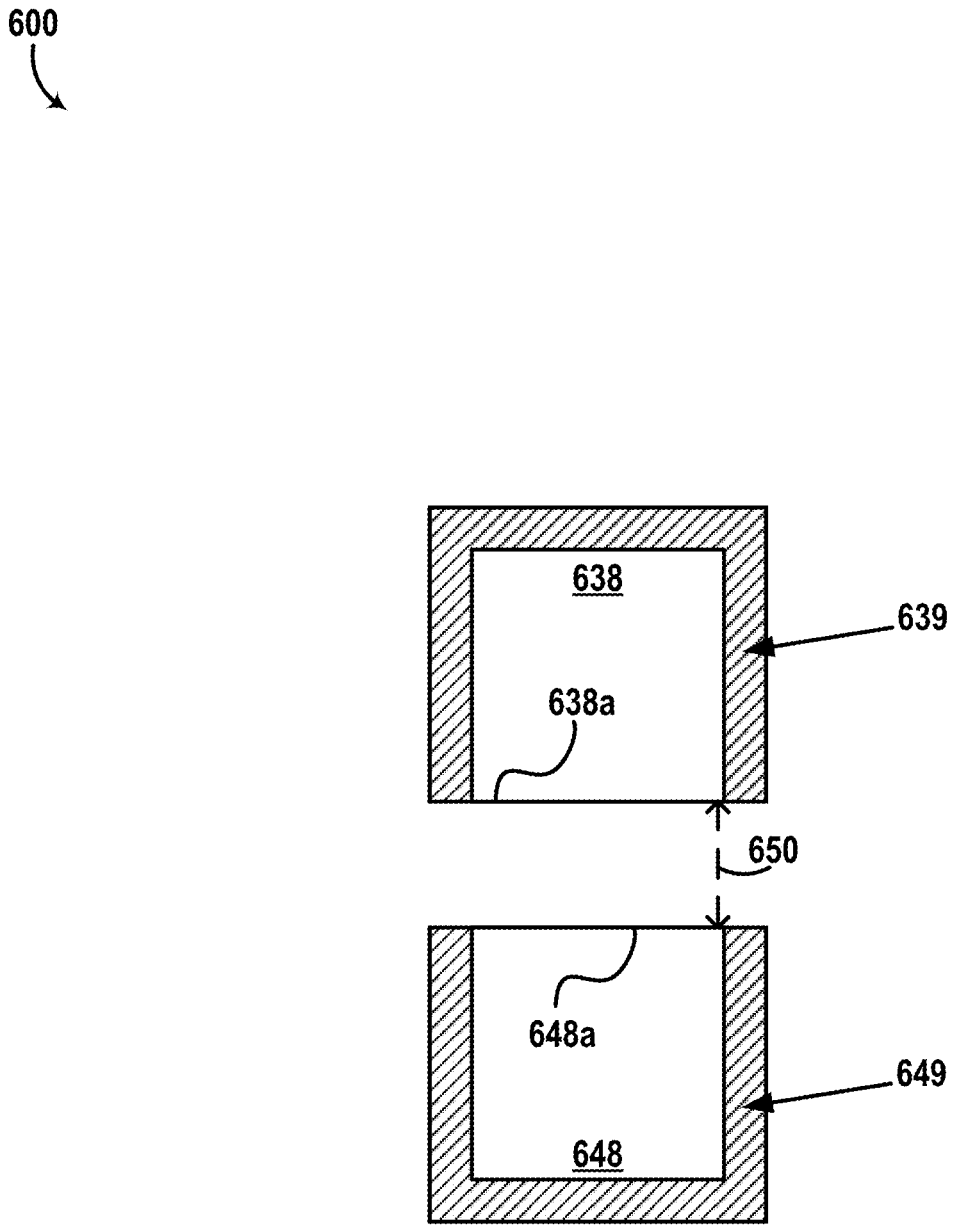
FIG. 6 illustrates a cross-section view of another device, according to an example embodiment.

FIG. 6 illustrates a cross-section view of another device 600, according to an example embodiment. The device 600 may be similar to the device 500 of FIGS. 5A-5C. For example, as shown, the device 600 includes a first dielectric waveguide 638 having a first side 638*a* and a second dielectric waveguide 648 having a second side 648*a* that are similar, respectively, to the first dielectric waveguide 538, the first side 538*a*, the second dielectric waveguide 548, and the second side 548*a* of the device 500. Further, as shown, the first side 638*a* is positioned at a predetermined distance 650 (similar to the predetermined distance 550 of the device 500) to the second side 648*a*.

As shown, the device 600 also includes a cladding layer 639 disposed on three sides of the first waveguide 638 other than the first side 638*a*. And the device 600 also includes a cladding layer 649 disposed on three sides of the second waveguide 648 other than the second side 648*a*. However, in some embodiments, the cladding layers 639 and 649 may be disposed on fewer or more sides than those shown in FIG. 6.

The cladding layers 639 and 649 are similar, respectively, to the cladding layers 439 and 449 of the device 400. For example, the cladding layers 639 and 649 may comprise a dielectric material (e.g., polymer, etc.) that has a different index of refraction than a given index of refraction of the dielectric materials in the respective waveguides 638, 648. In one embodiment, the indexes of refraction of the respective cladding layers 639, 649 may be less than the respective indexes of refraction of the waveguides 638, 648. However, in some examples, the cladding layers 639, 649 may take other forms and/or may include other materials as well.

In some examples, as noted above, the cladding layers 639, 649 may improve internal reflection of RF waves propagating inside the respective waveguides 638, 648, at least at the sides where the respective cladding layers 639, 649 are disposed, as shown in FIG. 6. As a result, in these examples, a larger portion of energy from the RF waves propagating inside the respective waveguides 638, 648 may evanesce at the respective adjacent sides 638*a*, 648*a* of the waveguides 638, 648. Through this process, for example, the device 600 may allow an improved performance of the wireless communication described above with respect to the device 500, and/or an increased predetermined distance 650.

IV. ILLUSTRATIVE METHODS AND COMPUTER-READABLE MEDIA

Figure 7:
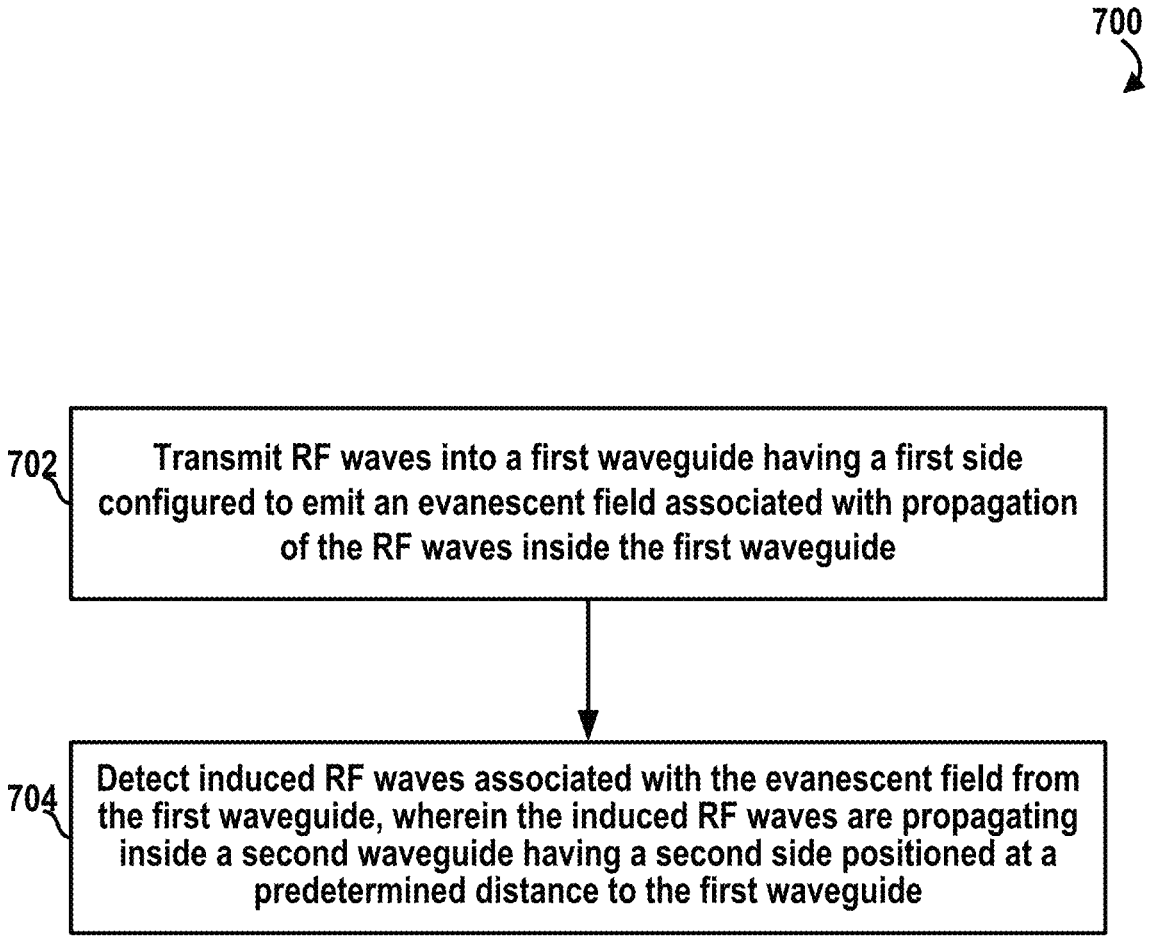
FIG. 7 is a flowchart of a method, according to an example embodiment.

FIG. 7 is a flowchart of a method 700, according to an example embodiment. Method 700 shown in FIG. 7 presents an embodiment of a method that could be used with any of the vehicles 100, 200, the LIDARs 120, 122, 130, 300, and/or the devices 400, 500, 600, for example. Method 700 may include one or more operations, functions, or actions as illustrated by one or more of blocks 702-704. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation.

In addition, for the method 700 and other processes and methods disclosed herein, the flowchart shows functionality and operation of one possible implementation of present embodiments. In this regard, each block may represent a module, a segment, a portion of a manufacturing or operation process, or a portion of program code, which includes one or more instructions executable by a processor for implementing specific logical functions or steps in the process. The program code may be stored on any type of computer readable medium, for example, such as a storage device including a disk or hard drive. The computer readable medium may include non-transitory computer readable medium, for example, such as computer-readable media that stores data for short periods of time like register memory, processor cache and Random Access Memory (RAM). The computer readable medium may also include non-transitory media, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, for example, or a tangible storage device.

In addition, for the method 700 and other processes and methods disclosed herein, each block in FIG. 7 may represent circuitry that is wired to perform the specific logical functions in the process.

At block 702, the method 700 involves transmitting radio-frequency (RF) electromagnetic waves into a first dielectric waveguide configured to guide propagation of the RF waves inside the first dielectric waveguide. A first side of the first dielectric waveguide is configured to emit an evanescent field associated with the propagation of the RF waves inside the first dielectric waveguide. Referring back to FIG. 5B, for example, the RF waves (e.g., RF waves 560) may be transmitted via a probe (e.g., probe 536) into the first dielectric waveguide (e.g., waveguide 560), and the first side (e.g., side 538*a*) of the first dielectric waveguide may responsively emit an evanescent field (e.g., field 570*a*-570*b*).

In some examples, the method 700 may also involve receiving data from a sensor, and modulating the transmitted RF waves to indicate the data from the sensor. For example, referring back to FIG. 4, the data from the sensor (e.g., sensor 432) may be received via a controller (e.g., controller 434), which may then operate a probe (e.g., probe 436) to modulate the transmitted RF waves such that the RF waves are indicative of the data from the sensor (e.g., frequency modulation, amplitude modulation, etc.).

At block 704, the method 700 involves detecting induced RF waves propagating inside a second dielectric waveguide having a second side positioned within a predetermined distance to the first side of the first dielectric waveguide. The induced RF waves are associated with the evanescent field from the first dielectric waveguide. Referring back to FIG. 5C, for example, the induced RF waves (e.g., waves 580), which are propagating inside the second dielectric waveguide (e.g., waveguide 548) positioned within the predetermined distance to the first waveguide (e.g., distance 550), and which are associated with the evanescent field (e.g., field 570*c*-*d*), may be detected via a probe (e.g., probe 546).

In some examples, the method 700 may also involve rotating the first dielectric waveguide relative to the second dielectric waveguide such that the first side of the first dielectric waveguide remains within the predetermined distance to the second side of the second dielectric waveguide in response to the rotating. For example, referring back to FIG. 5A, the first dielectric waveguide (e.g., waveguide 538) may be rotated relative to the second dielectric waveguide (e.g., waveguide 548) while maintaining an overlap between the first side (e.g., side 538*a*) and the second side (e.g., side 548*a*) within the predetermined distance based on a shape of the respective sides.

In some examples, the method 700 may also involve receiving operation instructions for a device coupled to the second dielectric waveguide, and modulating the transmitted RF waves to indicate the operating instructions. For example, referring back to FIG. 4, a controller (e.g., controller 444) may receive operating instructions for a device (e.g., sensor 432, actuator 410, etc.), and may thereby operate a probe (e.g., probe 446) to modulate the transmitted RF waves to indicate such instructions for receipt by another probe (e.g., probe 436) via an evanescent field (e.g., field 404) between the respective waveguides (e.g., waveguides 448, 438) of the two probes.

Further, in some examples, the method 700 may also involve transmitting second RF waves for propagation inside the second dielectric waveguide. In these examples, the second side of the second dielectric waveguide may be configured to emit a second evanescent field associated with the propagation of the second RF waves inside the second dielectric waveguide. Further, in these examples, the method 700 may also involve detecting particular induced RF waves propagating inside the first dielectric waveguide, where the particular induced RF waves are associated with the second evanescent field from the second dielectric waveguide. For example, referring back to FIG. 4, the method 700 may be performed by a device that supports wireless communication between two probes (e.g., probes 436, 448) via two evanescent fields (e.g., fields 402, 404) associated with respective RF waves emitted by each probe, in line with the description of the device 400 of FIG. 4.

Figure 8:
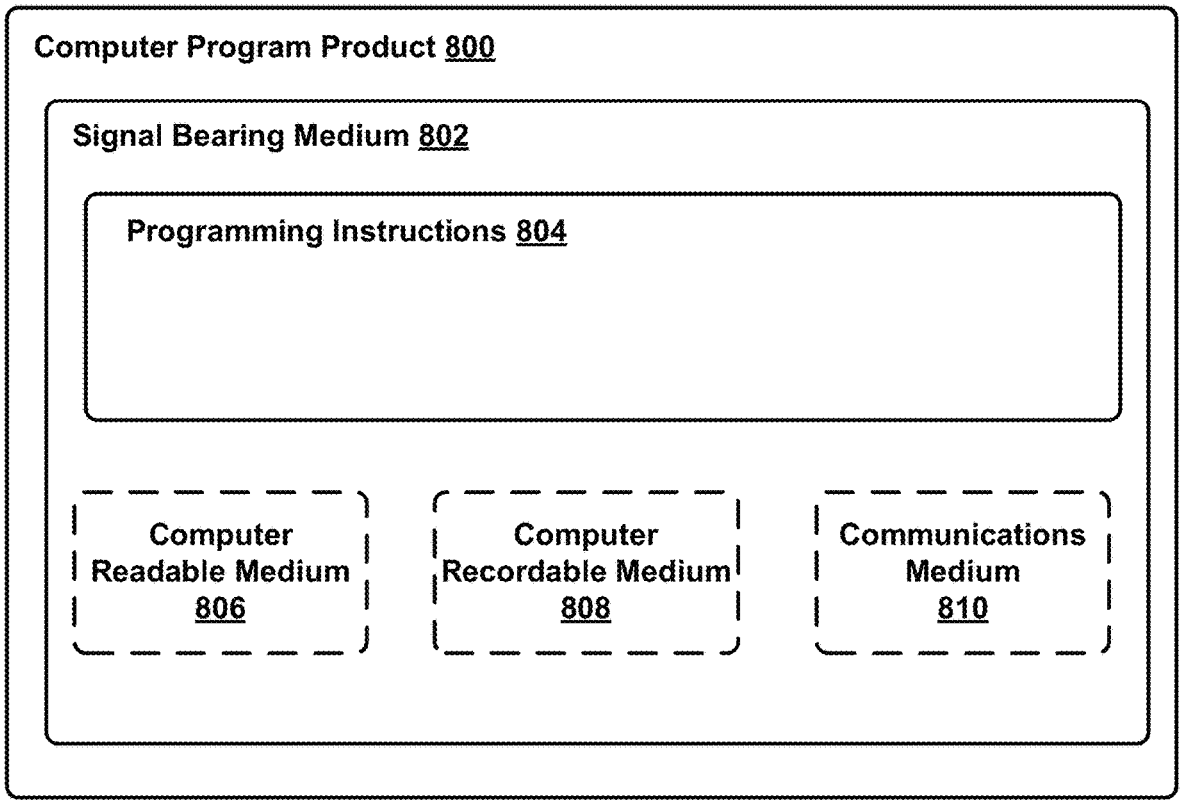
FIG. 8 depicts a computer readable medium configured according to an example embodiment.

FIG. 8 depicts a computer readable medium configured according to an example embodiment. In example embodiments, an example system may include one or more processors, one or more forms of memory, one or more input devices/interfaces, one or more output devices/interfaces, and machine readable instructions that when executed by the one or more processors cause the system to carry out the various functions, tasks, capabilities, etc., described above.

As noted above, in some embodiments, the disclosed techniques (e.g., method 700, etc.) may be implemented by computer program instructions encoded on a computer readable storage media in a machine-readable format, or on other media or articles of manufacture (e.g., instructions 216 of the vehicle 200, etc.). FIG. 8 is a schematic illustrating a conceptual partial view of an example computer program product that includes a computer program for executing a computer process on a computing device, arranged according to at least some embodiments disclosed herein.

In one embodiment, the example computer program product 800 is provided using a signal bearing medium 802. The signal bearing medium 802 may include one or more programming instructions 804 that, when executed by one or more processors may provide functionality or portions of the functionality described above with respect to FIGS. 1-7. In some examples, the signal bearing medium 802 may be a non-transitory computer-readable medium 806, such as, but not limited to, a hard disk drive, a Compact Disc (CD), a Digital Video Disk (DVD), a digital tape, memory, etc. In some implementations, the signal bearing medium 802 may be a computer recordable medium 808, such as, but not limited to, memory, read/write (R/W) CDs, R/W DVDs, etc. In some implementations, the signal bearing medium 802 may be a communication medium 810 (e.g., a fiber optic cable, a waveguide, a wired communications link, etc.). Thus, for example, the signal bearing medium 802 may be conveyed by a wireless form of the communications medium 810.

The one or more programming instructions 804 may be, for example, computer executable and/or logic implemented instructions. In some examples, a computing device may be configured to provide various operations, functions, or actions in response to the programming instructions 804 conveyed to the computing device by one or more of the computer readable medium 806, the computer recordable medium 808, and/or the communications medium 810.

The computer readable medium 806 may also be distributed among multiple data storage elements, which could be remotely located from each other. The computing device that executes some or all of the stored instructions could be an external computer, or a mobile computing platform, such as a smartphone, tablet device, personal computer, wearable device, etc. Alternatively, the computing device that executes some or all of the stored instructions could be remotely located computer system, such as a server.

V. CONCLUSION

Within exemplary embodiments, systems, devices and methods are provided for a rotary joint that facilitates communication between a moveable component and other components, while mitigating effects of relative motion between the respective components. In one example embodiment, dielectric waveguides are used as a wireless communication interface between two probes. In this embodiment, a first waveguide emits an evanescent field, associated with RF waves propagating inside the first waveguide, towards a second waveguide such that the evanescent field induces RF waves for propagation inside the second waveguide. Thus, in this embodiment, the induced RF waves may be received by a probe coupled to the second waveguide, and the information indicated by the RF waves propagating inside the first waveguide may be effectively communicated to the probe coupled to the second waveguide. Other implementations are possible as well in line with the exemplary embodiments described in the present disclosure.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location, or other structural elements described as independent structures may be combined.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A device comprising:

a first waveguide;

a second waveguide;

a dielectric fluid interposed between the first waveguide and the second waveguide;

a first probe that emits first electromagnetic (EM) waves into the first waveguide, wherein the first waveguide guides the first EM waves, and wherein the first EM waves guided inside the first waveguide induce second EM waves in the second waveguide;

a second probe, wherein the second waveguide guides the second EM waves toward the second probe; and an actuator that rotates the first waveguide, wherein the first waveguide remains within a given distance to the second waveguide in response to the actuator rotating the first waveguide.

2. The device of claim 1, wherein the first waveguide emits an evanescent field associated with the first EM waves guided inside the first waveguide, and wherein the second EM waves are induced in the second waveguide based on the evanescent field.

3. The device of claim 2, wherein the first waveguide has a first side that emits at least a portion of the evanescent field toward a second side of the second waveguide, and wherein the first side remains within the given distance to the second side in response to the actuator rotating the first waveguide.

4. The device of claim 1, wherein the first waveguide comprises a dielectric material, and wherein the second waveguide comprises the dielectric material.

5. The device of claim 1, wherein the first waveguide extends around an axis of rotation of the first waveguide, and wherein the second waveguide extends around the axis of rotation of the first waveguide.

6. The device of claim 1, wherein the first waveguide and the second waveguide are concentrically arranged about a common axis, and wherein the actuator rotating the first waveguide comprises the actuator rotating the first waveguide about the common axis.

7. The device of claim 1, wherein the first waveguide has a substantially circular-arc shape, and wherein the second waveguide has a corresponding substantially circular-arc shape.

8. The device of claim 1, wherein the actuator rotates the first waveguide at least one complete rotation about an axis, and wherein a first side of the first waveguide remains within the given distance to a second side of the second waveguide during the at least one complete rotation.

9. The device of claim 1, wherein the actuator rotates the first waveguide at least one complete rotation about an axis, and wherein a first side of the first waveguide remains at least partially overlapping a second side of the second waveguide during the at least one complete rotation.

10. The device of claim 1, further comprising:

a sensor;

a first controller that receives data from the sensor and provides a modulated signal indicative of the data to the first probe, wherein the first probe modulates the emitted first EM waves based on the modulated signal; and a second controller that receives a signal from the second probe and determines the data from the sensor based on the received signal.

11. A device comprising:

a first waveguide;

a second waveguide;

a dielectric fluid interposed between the first waveguide and the second waveguide;

a first probe, wherein the first waveguide guides first electromagnetic (EM) waves toward the first probe;

a second probe that emits second EM waves into the second waveguide, wherein the second waveguide guides the second EM waves, and wherein the second EM waves guided inside the second waveguide induce the first EM waves in the first waveguide; and an actuator that rotates the first waveguide, wherein the first waveguide remains within a given distance to the second waveguide in response to the actuator rotating the first waveguide.

12. The device of claim 11, wherein the first waveguide and the second waveguide are concentrically arranged about a common axis, and wherein the actuator rotating the first waveguide comprises the actuator rotating the first waveguide about the common axis.

13. The device of claim 11, wherein the second waveguide emits an evanescent field associated with the second EM waves guided inside the second waveguide, and wherein the first EM waves are induced in the first waveguide based on the evanescent field.

14. A method comprising:

emitting, via a first probe, first electromagnetic (EM) waves into a first waveguide, wherein the first waveguide guides the first EM waves, and wherein the first EM waves guided inside the first waveguide induce second EM waves in a second waveguide;

detecting, via a second probe, the induced second EM waves, wherein the second waveguide guides the induced second EM waves toward the second probe;

transmitting, via the second probe, third EM waves into the second waveguide, wherein the second waveguide guides the third EM waves, and wherein the third EM waves induce fourth EM waves in the first waveguide;

detecting, via the first probe, the induced fourth EM waves, wherein the first waveguide guides the fourth EM waves toward the first probe; and rotating the first waveguide, wherein the first waveguide remains within a given distance to the second waveguide during the rotating.

15. The method of claim 14, wherein the second waveguide emits an evanescent field associated with the third EM waves guided inside the second waveguide, and wherein the fourth EM waves are induced in the first waveguide based on the evanescent field.

16. The method of claim 14, wherein the first waveguide emits an evanescent field associated with the first EM waves guided inside the first waveguide, and wherein the second EM waves are induced in the second waveguide based on the evanescent field.

17. The method of claim 14, further comprising:

receiving data collected by a sensor; and modulating the first EM waves to indicate the data from the sensor.

18. The method of claim 14, further comprising:

receiving operation instructions for a device coupled to the first probe; and modulating the third EM waves to indicate the operation instructions.

* * * * *